United States Patent [19]

Scarborough

[11] Patent Number: 5,054,410

[45] Date of Patent: Oct. 8, 1991

[54] HYDROFOIL SAILBOAT WITH CONTROL SYSTEM

[76] Inventor: Greer T. Scarborough, 1125 Monterey, #1, Hermosa Beach, Calif. 90254

[21] Appl. No.: 457,848

[22] Filed: Dec. 27, 1989

[51] Int. Cl.[5] ..... B63H 9/04

[52] U.S. Cl. ..... 114/391; 114/61; 114/275; 114/280

[58] Field of Search ..... 114/39.2, 61, 89, 90, 114/270, 274, 275, 280, 282, 39.1

[56] References Cited

U.S. PATENT DOCUMENTS

| | | | |
|---|---|---|---|
| 288,819 | 11/1883 | Kraeger | 114/90 |
| 3,373,710 | 3/1968 | Steinberg | 114/280 |
| 3,747,549 | 7/1973 | Shutt | 114/280 |
| 3,789,789 | 2/1974 | Cleary | 114/280 |
| 3,949,695 | 4/1976 | Pless . | |
| 4,228,750 | 10/1980 | Smith et al. | 114/280 |
| 4,421,491 | 12/1983 | Pleass | 114/90 |
| 4,582,011 | 4/1986 | Logan | 114/280 |

OTHER PUBLICATIONS

"Feedback and Control Systems", Schaum's Outline Series Published by McGraw-Hill Book Company.

*Primary Examiner*—Sherman D. Basinger
*Assistant Examiner*—Stephen P. Avila
*Attorney, Agent, or Firm*—Charles H. Thomas

[57] ABSTRACT

A multi-hulled sailing vessel is provided with a pair of aileron foils that are mounted outboard from each of two sponsons that are rigidly joined to a central main hull. The aileron foils are rotatable about axes that are inclined toward each other when deployed. Each of the sponsons is provided with a mast carrying a sail. The masts are coupled together by a pair of transverse stabilizing struts. The masts are each supported by separate shroud systems. The vessel is equipped with load sensing and foil control means coupled to at least some of the shrouds and to the aileron foils so as to rotate the aileron foils about their axes responsive to loads in the shrouds. A rudder at the rear of the central main hull is provided with a transversely mounted elevator foil which is also rotated about an axis transverse to the rudder responsive to loads in the shrouds. The foils and the rudder are mounted for rotation relative to the sponsons and the central main hull and can be brought entirely out of the water.

29 Claims, 21 Drawing Sheets

HYDROFOIL SAILBOAT WITH CONTROL SYSTEM

BACKGROUND OF THE INVENTION

1. Field of the Invention

The present invention relates to a sailing vessel equipped with hydrofoils that are operated responsive to loads on the sails.

2. Description of the Prior Art

Multi-hull sailing vessels have been devised which include hydrofoils rotatable about axes that are inclined toward each other. Rotation of the hydrofoils about their axes adjusts the angle of attack of each hydrofoil as the hydrofoil moves through the water so as to aid in maintaining the vessel in an upright position. However, adjustment of the hydrofoils has heretofore been performed either manually or responsive to the pressure of the water on the hydrofoil surface as the hydrofoil moves through the water. One such conventional system is described in U.S. Pat. No. 3,949,695.

SUMMARY OF THE INVENTION

The present invention is a sailing vessel of the type employing a pair of sponsons located on opposite sides of a central main hull in which a separate mast and supporting shroud system is provided for each sponson and in which the speed and comfort of movement is dramatically improved over conventional systems. The sailing vessel of the invention is provided with aileron foils, the angles of attack of which are automatically adjusted by loads in the sails which are transmitted to the aileron foils from the shroud system. A sailing vessel equipped with the hydrofoils of the invention has far greater stability than conventional multi-hulled vessels. Furthermore, this stability is totally unaffected by waves. By employing the automated hydrofoil adjustment system the vessel can utilize larger more powerful sails and will exhibit far less drag from submerged surfaces as contrasted with conventional sailing vessels. A sailing vessel according to the present invention can move at approximately two to three times the speed of the wind under sail power only in moderate to heavy wind conditions with almost no rolling or pitching.

One principal of operation involved in the construction of the sailing vessel of the invention is that the heeling force on the sails is proportional to the load in the shrouds that laterally support the masts because the shrouds are the stiffest load path. Therefore, by connecting the shrouds to the hydrofoils by means of proportional load sensors and a pulley system, the foils will rotate about their respective axes proportionally to the load on the shrouds to counteract the heeling forces because the center of pressure on the foils is approximately a constant distance from the axis of rotation. Likewise, the forces in the fore and aft stays are proportional to loads in the sail that cause the vessel to pitch in a fore and aft direction. In addition, flaperons using ground effect assist these foils in countering heeling forces.

Since there can be some nonproportional forces, the foils are mounted in such a manner that the inclination of their axes of rotation relative to horizontal and to each other can be manually adjusted. Also, the main adjustable foils can be provided with small, fixed ladder-type foils. The aileron foils of the sailing vessel of the invention are preferably provided with passive roll control foils, as well as with a dynamic roll control system. In addition, a manually originated bias can be superimposed upon the automated controls to selectively adjust the trim of the adjustable foils.

Improved safety is a very important advantage of the sailing vessel of the present invention over conventional multi-hulled vessels. The sailing vessel of the present invention will no capsize because of the increased stability created by the control system and the addition of other mechanisms to enhance the stabilization of the vessel in unusual or dangerous sea conditions. Also, because of its great speed, the vessel of the present invention can often outrun a storm so that it can frequently reach the safety of a port before encountering the full force of a storm.

A sailing vessel designed according to the invention provides a dramatic increase in speed and smoothness of a ride. The improved multi-hulled sailing vessel of the invention provides a heretofore unattainable means for allowing boaters to travel many hundreds of miles to secluded islands for brief vacations. Such journeys have previously been impractical since conventional sail boats move at such slow speeds and since power driven yachts require large expensive engines and consume great amounts of very expensive marine fuel.

A sailing vessel according to the invention will also find considerable use by people who have heretofore not engaged in sailing due to seasickness resulting from the rugged pitching and rolling which is characteristic of conventional sail boats. A sailing vessel according to the invention significantly increases the comfort of sailing by drastically reducing pitching and rolling, while concurrently allowing a sail boat to move much more rapidly through the water than has previously been possible.

Multi-hull sailing vessels have historically been highly unstable and have provided rides which are uncomfortable to many due to excessive heeling. In conventional sail boats, especially multi-hulled vessels, virtually every loose article must be lashed down to prevent it from being thrown about by the violent pitching and rolling movements encountered while under sail. In a sailing vessel according to the design of the present invention, however, even business and other work can be performed on tables within the cabins of the vessel while under sail. Unlike conventional vessels, the rolling and heeling of a sailing vessel according to the present invention is so diminished during normal wind and sea conditions that even articles placed atop tables will not slide off.

The sailing vessel of the invention my also include special safety features to prevent it from capsizing in dangerous sea conditions. During a gale or other storm large sea waves are frequently created that tend to cause a multi-hulled sailing vessel to roll over on its side. By adding floats, preferably in the form of inflatable air bags at both ends of the upper transverse stabilizing strut, the sailing vessel will be self-righting even if it is knocked down by the force of a storm. The sailing vessel will not lie on its side in a stable manner since a float on the outboard end on the leeward side of the upper transverse stabilizing strut will prevent the vessel from being knocked down by more than about 80 degrees. Therefore, the center of gravity of the sailing vessel, which acts through the main central hull, will produce a moment that will tend to right the sailing vessel. Also, since the hull is constructed of honeycomb, sandwich composites the sponsons and the main central hull will have a considerable amount of entrapped air in their structures. The sailing vessel therefore is essentially unsinkable.

One safety hazard which does exist with the high speed vessel of the invention is the danger of a roll over at high speed caused by a damaged windward aileron foil. Partially submerged objects, such as logs and other flotsam and jetsam do exist in the ocean. Since the sailing vessel of the invention does travel at an extremely high rate of speed, it is possible that an aileron foil could strike such an object and shear off while the sailing vessel is in motion. The absence of one of the aileron foils would seriously affect both the stability and operability of the sailing vessel. Thus, if one of the aileron foils were to be sheared off far at sea the sailing vessel would be helpless and unable to proceed under its own power to a port where a replacement aileron foil could be obtained. Also, the sponson could be seriously damaged since the impact of an aileron foil against an obstacle could tear a support beam out of the sponson with considerable destruction.

To guard against such an occurrence, the support beams carrying the aileron foils can be mounted relative to the sponsons upon which they are carried by replaceable bolts designed to shear off and thereby yield to allow the aileron foil and support beam to rotate relative to the sponson so that there will be little damage in the event an aileron foil strikes a large solid object while traveling at high speed. When the shear bolts fail they preferably release cables that are coupled to control the main sheets of the sails. Thus, the failure of the shear bolts holding an aileron foil and support beam on a sponson will allow the aileron foil to rotate freely relative to the sponson and away from the obstruction. Furthermore, the automatic release of the main sheets eliminates the heeling force that would result if an aileron foil were to rise out of the water while the vessel is under way at high speed. This heeling force would otherwise act upon the sailing vessel to tend to flip it on its side. However, a sudden automatic release of the main sheets will cause the sails to luff and the sailing vessel to rapidly but safely decelerate and allow it to settle back in the water in an upright position. Damage to the vessel and possible injury to the occupants of the vessel can thereby be minimized.

The improved sailing vessel of the invention also provides a new dramatic dimension to sail boat racing. The vessel design of the present invention allows sail boats to travel at speeds comparable to those of power racing boats during heavy wind conditions.

A further advantage of sailing vessels according to the invention is the provision of a rapid and practical form of transportation in isolated islands, which experience heavy prevailing winds, such as many islands in the South Pacific. In these locations the cost of importing consumable petroleum based fuels for conventional modes of transportation is extremely high. A sailing vessel according to the invention provides an effective and reliable form of wind powered transportation in heavy and moderate wind conditions of the type which prevail in many South Pacific island locations.

In one broad aspect the present invention may be considered to be a sailing vessel comprising a central main hull, a pair of sponsons located alongside the central main hull in spaced separation therefrom and rigidly joined thereto, a mast supported on each sponson for carrying a sail, shrouds supporting the masts, a pair of aileron foils mounted outboard from each of the sponsons about axes inclined toward each other, and load sensing and foil control means coupled to at least some of the shrouds and to the aileron foils to rotate the aileron foils about their axes responsive to loads in the shrouds.

Preferably the load sensing and foil control means is comprised of rotational driving means for each of the aileron foils for turning the aileron foils in rotation about their respective axes, and an endless loop cable coupled to both of the rotational driving means. Longitudinal advancement of the endless loop cables turns the aileron foils in counter-rotation relative to each other. The load sensing and foil control means preferably also includes proportional load transducing means coupled to at least some of the shrouds to sense loads in the shrouds and to advance the endless loop cable with forces directly proportional to loads sensed in the shrouds.

Since the forces needed to optimally adjust the angle of attack of the foils are not always precisely proportional to loads in the shrouds, the sailing vessel of the invention preferably also comprises manually operable cable advancement adjustment means coupled to the endless loop cable in series with the proportional load transducing means. The manually operable cable advancement adjustment means allows manual adjustment of the advancement of the cable for specific prevailing conditions.

One system for providing the desired manual adjustment contemplates the mounting of the foils in articulated fashion from the sponsons by means of support beams. The support beams are mounted on the sponsons in a rotatable manner. The aileron foils are thereby rotatable with the support beams to allow adjustment of the inclination of the axes about which the aileron foils are rotatable. Preferably some form of hydraulic actuating means is employed to rotate the support beams relative to the sponsons.

Another means of providing manual adjustment for the cable advancement means involves the use of trim pulleys in the endless loop cable and hydraulic actuators coupled to the trim pulleys. The trim pulleys may thereby be operated to introduce a bias toward longitudinal advancement of the cable in either direction as appropriate.

As in conventional multi-hull sailing vessels that employ a central main hull, a rudder is located at the rear of the central main hull. However, unlike conventional sailing vessels a means is provided for reducing pitching of the vessel. To this end an elevator foil is disposed transversely relative to the rudder of the vessel and is mounted to the rudder for rotation about a transverse axis. Furthermore, a load sensing and elevator control means is coupled to at least some of the shrouds and to the elevator foil so as to rotate the elevator foil about the transverse axis responsive to loads in the shrouds. Preferably also, there are several small ladder-type passive pitch control foils that are mounted in a stationary position on the rudder and project laterally outwardly from the rudder above the rotatable elevator foil. These transversely projecting passive pitch control foils are shaped like horizontal fins projecting from both sides of the rudder and further reduce pitching of the vessel.

The rudder is mounted for rotation about a vertical rudder post and preferably is provided with a hydraulic rudder control means for controlling the rotation of the rudder at the rudder post. A rudder beam carries the rudder and the rudder post at the rear of the central main hull. A transverse hinge is provided for rotatably securing the rudder beam to the central main hull. A hydraulically actuated means is coupled to rotate the rudder beam on the transverse hinge means to alternatively raise and lower the rudder relative to a body of water in which the central main hull and the sponsons float.

Because a sailing vessel according to the invention moves at such high speeds and is capable of beating into the wind, and since the force of wind against an object increases as a square function of the relative wind velocity, the structure of the sailing vessel must be modified from that of conventional multi-hulled vessels to withstand the additional forces to which it is subjected. In this connection the masts on the two sponsons are cross connected together by transversely directed stabilizing struts located at different elevations above the levels of the sponsons. The stabilizing struts provide additional rigidity to the overall structure of the sailing vessel to aid in withstanding the heavy wind forces which develop in the sails. Also, the stabilizing struts aid in creating greater uniformity in the loadings on the masts and on the shroud system attached to each of the masts.

The sailing vessel of the invention includes separate shroud systems which support each of the masts. Each shroud system is comprised of an inboard and an outboard upper shroud, both of which are connected to the top of the mast. Both the inboard and outboard upper shrouds are secured to the multiple hulls through proportional load transducing means. Each proportional load transducing means is coupled between the upper shrouds and an aileron rotation actuating means to transmit a fraction of the loads in the shrouds to the aileron rotation actuating means. The aileron rotation actuating means is comprised of an endless loop cable formed into a loop and coupled to both of the aileron rotating actuating means.

The separate shroud systems associated with each mast are also comprised of aft stays that lead from the masts and are connected to other proportional load transducers that transmit a portion of the load from the aft stays to the elevator rotation mechanism. Preferably, each shroud system for each mast is comprised of both upper and lower aft stays, both of which are coupled to a common proportional load transducer for each shroud system. In one embodiment of the invention the pair of proportional load transducers for both shroud systems which controls rotation of the elevator are located on opposite sides of the central main hull on the outboard sides thereof approximately midway between the forestay and the stern. A pair of aft link cables extend from the proportional load transducers toward the stern of the central main hull 12. The aft link cables are coupled to the proportional load transducers and are also coupled together in the stern of the central main hull where they are joined to a single rearwardly extending elevator cable which leads to the elevator through the structure of the central main hull.

In an alternative embodiment of the invention each of the separate shroud systems is comprised of cross stays that extend from the mast mounted on one sponson, at different elevations thereabove, to the base of the mast mounted on the opposite sponson. In such an embodiment the cross stays are connected to the load sensing and control means for the aileron foils at the base of the masts and is coupled to the endless loop cable that is coupled to the aileron foils. Forestay means extend from each mast to the front of the sponson upon which the mast is mounted. In such an embodiment the load sensing and control means for the elevator is located at the rear of the central main hull and is coupled to the elevator to rotate the elevator foil about the transverse elevator axis. Each of the separate shroud means for each of the masts is comprised of aft stays that extend from the masts. All of the aft shrouds are connected to the same load sensing and pitch control means at the rear of the central main hull. The elevator foil rotates about the transverse elevator axis in response to loads in these aft stays. Preferably, there is at least an upper and a lower aft stay coupled to the same proportional load sensing means from each mast in this embodiment.

In still another variation of the invention the shroud systems for each of the masts is comprised of at least one forestay that extends from each mast to the bow of the central main hull. Dual forestays to the bow of the central main hull may be provided for each shroud system. One of the forestays leads to the top of a mast while the other forestay leads to an intermediate location on the same mast.

A further preferred feature of the invention involved the provision of flaperons which assist the aileron foils in retarding heeling of the vessel. The flaperons take advantage of the ground effect of a swiftly moving vessel that creates large lift to drag ratios. The flaperons can be employed to assist the aileron foils in counteracting the static heeling forces acting upon the vessel.

The flaperons are located on a monocoque bridge that extends between the central main hull and the sponsons. A pair of booms extend rearwardly from the bridges adjacent to each of the sponsons. The booms are rotatable in planes parallel to the sponsons and to the central main hull about transverse boom axes where the sponsons meet the bridge. Flexible sheets of material extend from each of the booms to the central main hull. Together, each boom and the sheet of material attached thereto, forms a flaperon extending rearwardly from the bridge. The flaperons are rotatable about the boom axes and are vertically adjustable relative to the sponsons.

When the vessel is under sail on a beat or a reach, the boom of the flaperon on the windward side is raised and the boom of the flaperon on the leeward side is lowered. The wind component acting rearwardly on the vessel parallel to the sponsons on the main central main hull acts on the flaperons create a moment on the vessel in opposition to the heeling force of the wind in the sails. This moment assists in countering roll moment provided by the aileron foils.

A further unique feature of the construction of the sailing vessel is the sail construction. Conventional sails are formed of a single layer of sailcloth typically constructed of nylon or kevlar. Each of sails of the present invention, on the other hand, is comprised of a pair of such sailcloths extending from a common leech. Each of the sailcloths in each sail is secured to a separate upright roller that is mounted adjacent and parallel to the mast upon which the sail is carried. The rollers are rotatable to selectively tighten and loosen the sailcloths to adjust the area and the aspect ratios of the sails. It is also advisable to construct the sails with reinforcing webbing on both of the sail cloths.

The invention may be described with greater clarity and particularity with reference to the accompanying drawings.

DESCRIPTION OF THE EMBODIMENTS

Figure 1:
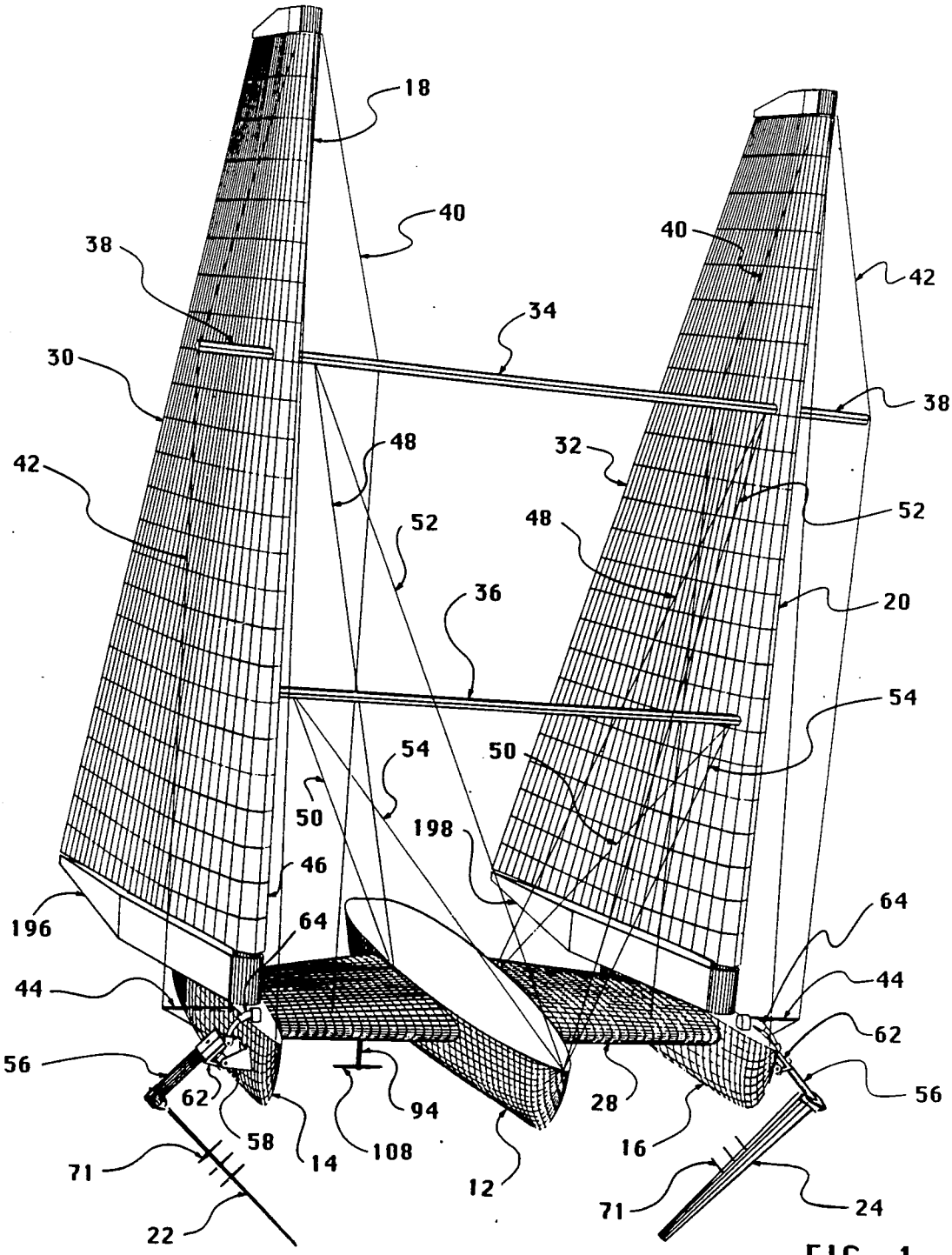
FIG. 1 is a perspective view of one preferred embodiment of a sailing vessel according to the invention with aileron foils deployed for moderate wind conditions.
Figure 6:
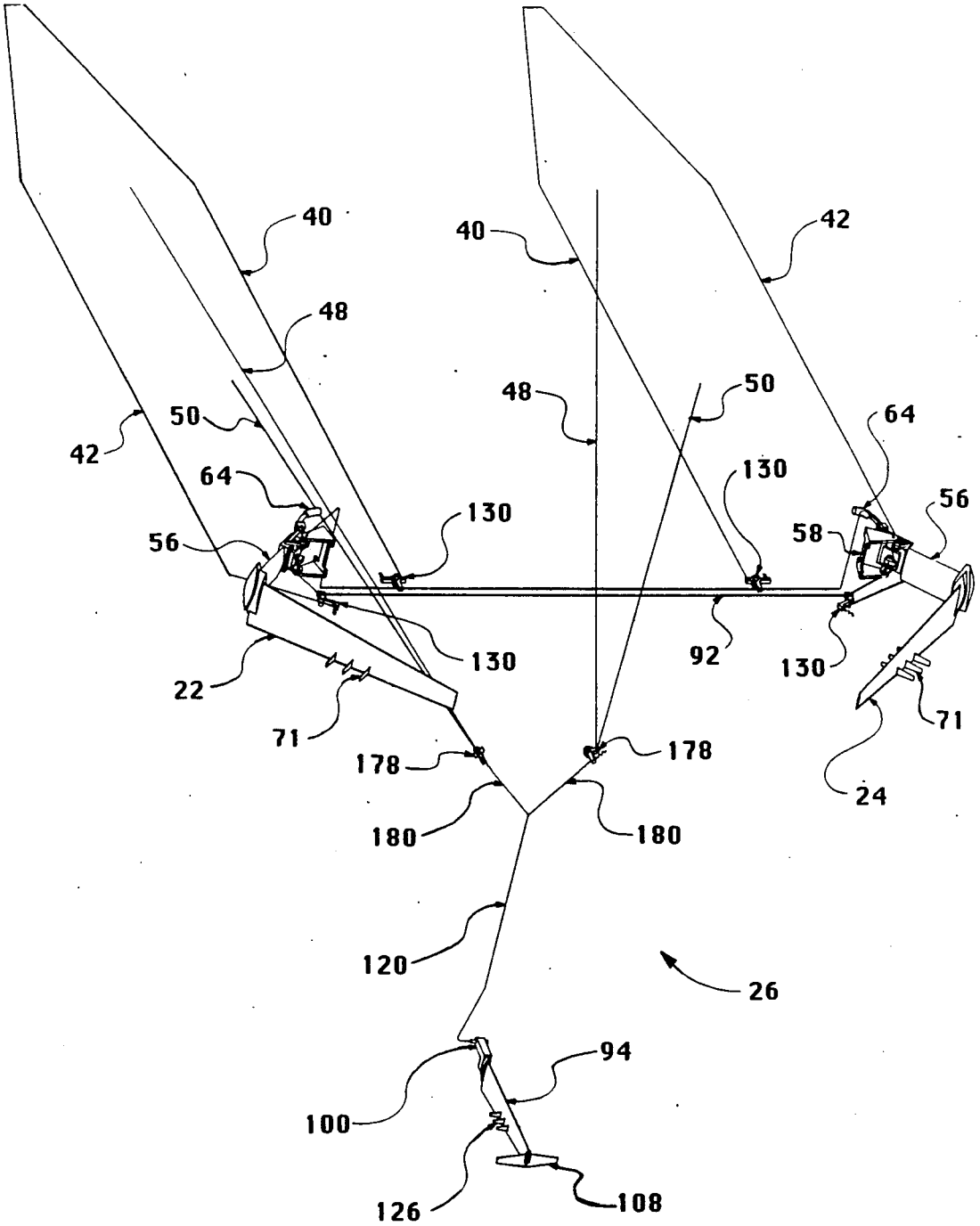
FIG. 6 is a trimetric view illustrating the load sensing and foil control means of the sailing vessel of FIG. 1.
Figure 7:
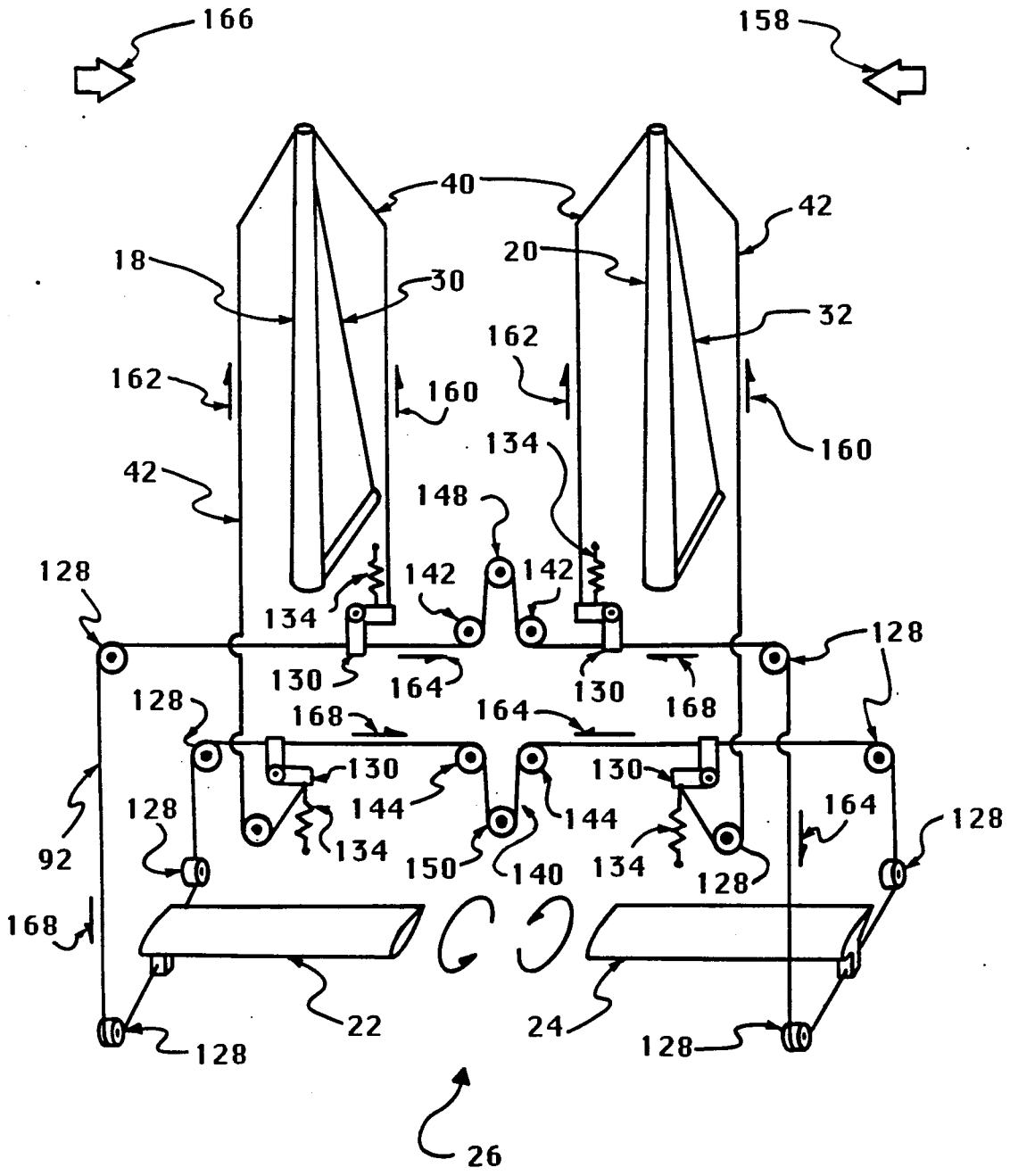
FIG. 7 is a diagrammatic illustration of the operation of the load sensing and foil control means of the vessel of FIG. 1.

FIG. 1 illustrates a sailing vessel 10 comprising a central main hull 12, a pair of sponsons 14 and 16, masts 18 and 20 each having a separate set of shrouds, a pair of aileron foils 22 and 24, and load sensing and foil control means indicated generally at 26 in FIGS. 6 and 7.

The central main hull 12 and the sponsons 14 and 16 are all formed of Kevlar or graphite with honeycomb sandwich construction. The central main hull 12 and the sponsons 14 and 16 are all elongated streamlined structures. The sponsons 14 and 16 are located alongside the central main hull 12 in spaced separation therefrom. The sponsons 14 and 16 are oriented parallel to the central main hull 12 and are located on opposite sides of it. The sponsons 14 and 16 are rigidly joined to the central main hull 12 by a monocoque bridge 28.

Each of the upright masts 18 and 20 carries a separate sail. The mast 18 carries a sail 30 while the mast 20 carries a sail 32. The mast 18 is mounted on the sponson 14 while the mast 20 is mounted on the sponson 16. The masts 18 and 20 are rigidly joined together by transversely directed upper and lower stabilizing struts 34 and 36. The stabilizing struts 34 and 36 both extend between the masts 18 and 20. The stabilizing strut 34 passes completely through both of the masts 18 and 20 to form outboard spreaders 38.

Shroud Systems

Each of the masts 18 and 20 is supported by a separate shroud system. The masts 18 and 20 are both supported by inboard upper shrouds 40 and outboard upper shrouds 42. The inboard upper shrouds 40 are attached to the upper strut 34 in spaced separation from and between the masts 18 and 20. The outboard upper shrouds 42 are attached to the outwardly directed extremities of the spreaders 38. The inboard shrouds 40 extend downwardly from the upper strut 34 and are anchored in the monocoque bridge 28 in spaced separation from and between the masts 18 and 20. The shrouds 40 are also connected to the load sensing and foil control means in a manner which will hereinafter be described. The outboard upper shrouds 42 extend downwardly and pass across spreaders 44 that extend outwardly from the outboard sides of the sponsons 14 and 16. The outboard upper shrouds 42 then pass inwardly and are anchored within the sponsons 14 and 16 and connected to the load sensing and foil control means 26 in a manner which will hereinafter be described as well.

Each of the shroud systems includes additional shrouds as well. Each shroud system includes an upper forestay 46 which extends from the top of the mast forwardly and downwardly. The upper forestays 46 are respectively anchored into the forward extremities of the bows of the sponsons 14 and 16. Each shroud system also includes an upper aft stay 48 and a lower aft stay 50 which are respectively connected to the transverse upper strut 34 and the transverse lower strut 36 proximate to the masts 18 and 20 on the inboard sides thereof. The aft stays 48 and 50 extend into the central main hull 12 and are anchored thereto and coupled to the load sensing and foil control means 26 in a manner hereinafter to be described.

Each shroud system also includes an upper forestay 52 and a lower forestay 54. The upper forestays 52 are secured to the transverse upper strut 34 proximate the masts 18 and 20 and extend therefrom to the bow of the central main hull 12. The lower forestays 54 are secured to the transverse lower strut 36 proximate the masts 18 and 20 and also extend therefrom to the bow of the central main hull 12.

Aileron Foils

The aileron foils 22 and 24 are substantially identical in construction and may be formed of stainless steel or silicon carbide titanium. Silicon carbide titanium construction will provide less drag because it provides a superior aspect ratio but is considerably more expensive than stainless steel. The construction of the aileron foils is illustrated in detail in FIGS. 10–13. The aileron foils 22 and 24 are elongated, paddle-shaped structures and are each mounted on a support beam 56. The support beams 56 are mounted on the sponsons 14 and 16 in a rotatable manner by means of mounting brackets 58. The bases of the mounting brackets 58 are secured to the structures of the sponsons 14 and 16. Each of the mounting brackets 58 has a pair of outwardly extending ears 60. The support beams 56 are each rigidly coupled to a bell crank assembly 62 that is rotatably coupled between the bracket ears 60. A hydraulic actuator 64 operates the bell crank 62. Actuation of the hydraulic actuator 64 rotates the bell crank 62 relative to the mounting bracket 58. Each bell crank 62 in turn is secured to a beam mounting plate 63 that in turn carries a support beam 56. The aileron foils 22 and 24 are connected to their respective support beams 56 and move in rotation about axes 61, depicted in FIG. 12, passing through the ears 60. The axes of rotation 61 are parallel to the alignment of the sponsons 14 and 16 and the central main hull 12.

Each of the aileron foils 22 and 24 is equipped with a set of mutually parallel passive roll foils 71. The passive roll foils 71 are oriented perpendicular to the alignment of the aileron foils 22 and 24 and are located on the trailing edges thereof. The foils 71 are formed as transversely projecting hydrofoil tabs which are secured to both sides of the aileron foils 22 and 24 to project laterally therefrom in fixed orthogonal relation relative thereto. The small passive roll foils 71 are located one above another in a ladder-type arrangement in vertical alignment with each other.

The purpose of the passive roll foils 71 is to cancel out inherent error signals from the control system and from inertial forces. They allow the feedback system of the invention to function even when the aileron foils 22 and 24 are in a position such that there is no angle of attack of the windward foil because the vessel 10 is traveling in perfect equilibrium. Under such conditions no dynamic energy changes occur to provide feedback signals to the load sensing and foil control system of the vessel 10 as will hereinafter be described in conjunction with FIG. 9. However, the passive roll foils 71 allow the feedback system of the invention to function in the absence of dynamic energy sources. The passive roll foils 71 aid in positioning the sponsons 14 and 16 out of the water and also serve to counteract any non-proportional roll moment loads. Since they are located on the trailing edges, they do not interfere with the dynamic effects of the aileron foils 22 and 24.

Figure 2:
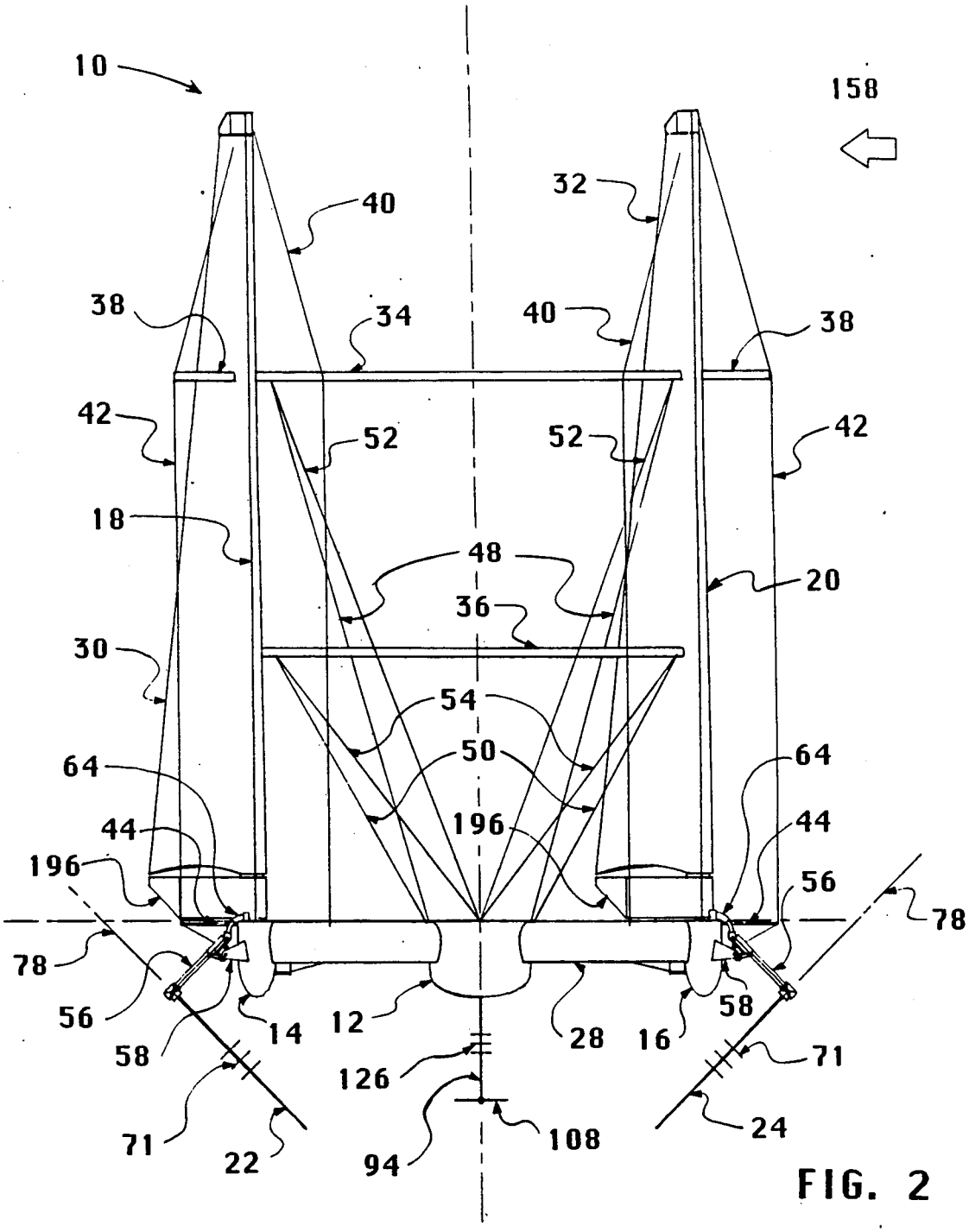
FIG. 2 is a front elevational view of the vessel of FIG. 1.
Figure 3:
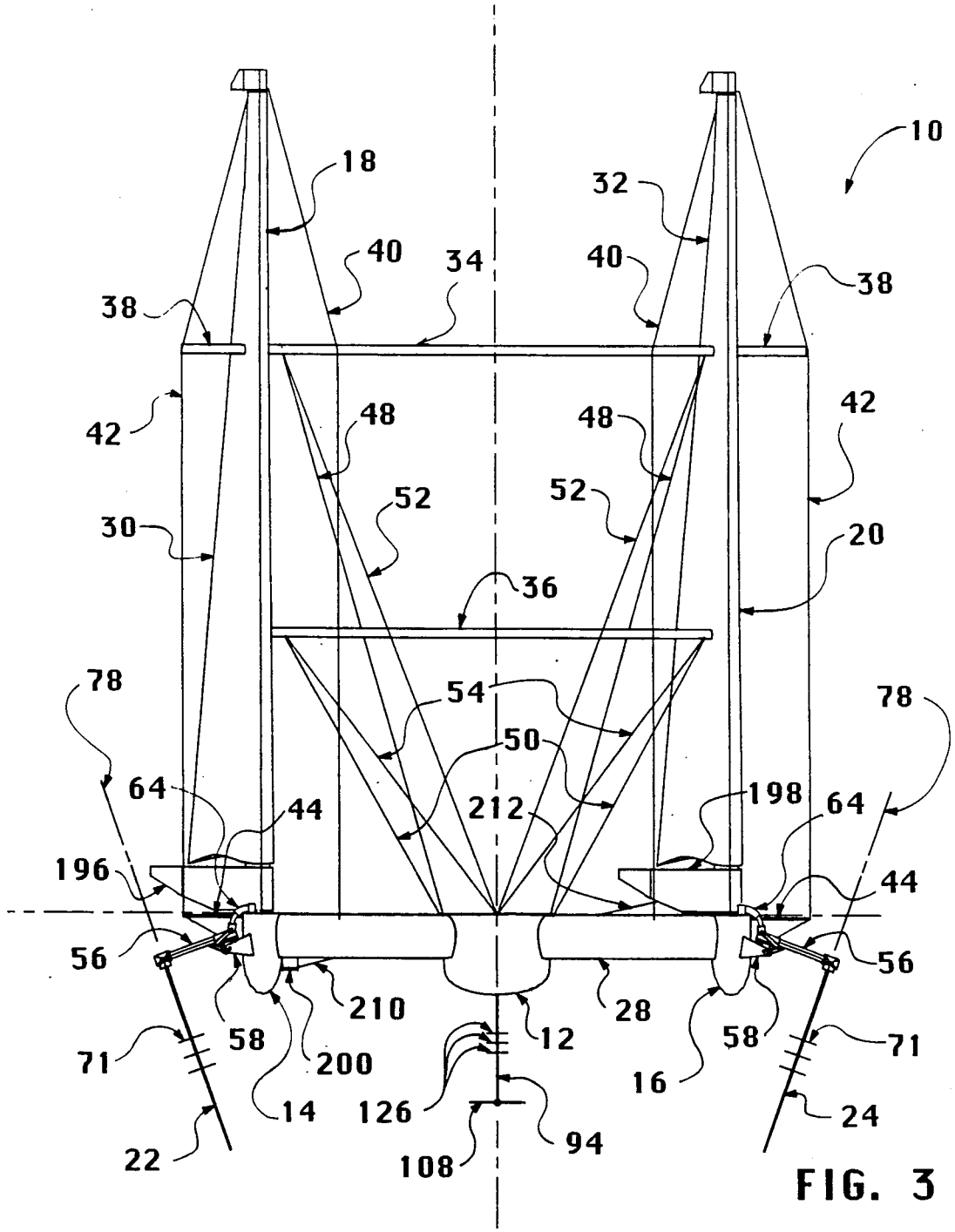
FIG. 3 is a front elevational view of the vessel of FIG. 1 with ailerons deployed for heavy wind conditions.
Figure 4:
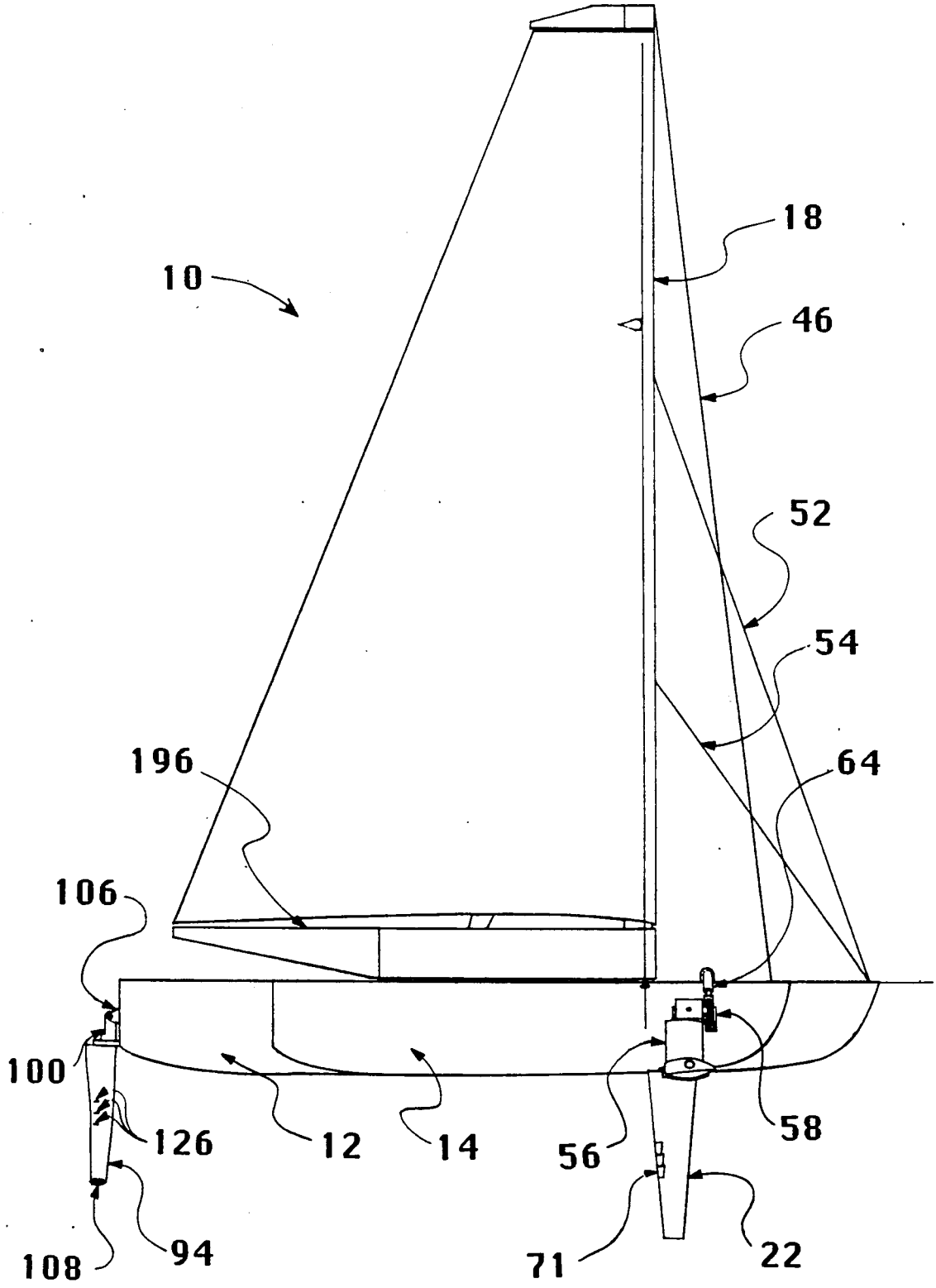
FIG. 4 is a side elevational view of the vessel of FIG. 1 with ailerons deployed as depicted in FIG. 3.

As illustrated in FIG. 1, the support beams 56 carry the aileron foils 22 and 24 outboard from the sponsons 14 and 16. The aileron foils 22 and 24 are adapted to extend downwardly on the outboard sides of each of the sponsons 14 and 16. The aileron foils 22 and 24 are inclined downwardly toward each other and are adapted for orientation at a variable inclination relative to each other and to the horizontal, as best depicted in FIGS. 1, 2 and 3.

The hydraulic actuators 64 are secured relative to the sponsons 14 and 16 and have piston rods 66 that move within hydraulic cylinders 68. Extension of the piston rods 66 from the cylinder tubes 68 of the hydraulic actuators 64 rotates the bell crank 62 downwardly relative to the brackets 58. The support beams 56 and the aileron foils 22 and 24 are likewise carried in rotation downwardly about the axes 61. The piston rods 66 are normally extended in this manner from the cylinder tubes 68 during moderate wind conditions of from seven to fifteen knots. When the piston rods 66 are extended from the cylinder tubes 68 in this manner, the aileron foils 22 and 24 will assume a disposition for moderate wind conditions, as depicted in FIG. 2. The aileron foils 22 and 24 act as water wings when deployed in this manner.

In heavier wind conditions it is desirable to raise the aileron foils 22 and 24 somewhat. When the piston rods 66 are partially retracted into the cylinder tubes 68, the bell cranks 62 are rotated upwardly about the axes 61, thereby drawing the support beams 56 and the aileron foils 22 and 24 upwardly as well. Partial retraction of the piston rods 66 in this manner draws the ailerons 22 and 24 upwardly so that the angle between the aileron foils 22 and 24 decreases to a much more acute angle, as depicted in FIG. 3. The deployment of the aileron foils 22 and 24 in the orientation of FIG. 3 is suitable for operation of the sailing vessel 10 in heavy wind conditions, fifteen knots and above. When the aileron foils 22 and 24 are deployed in this manner they act as centerboards.

Figure 5:
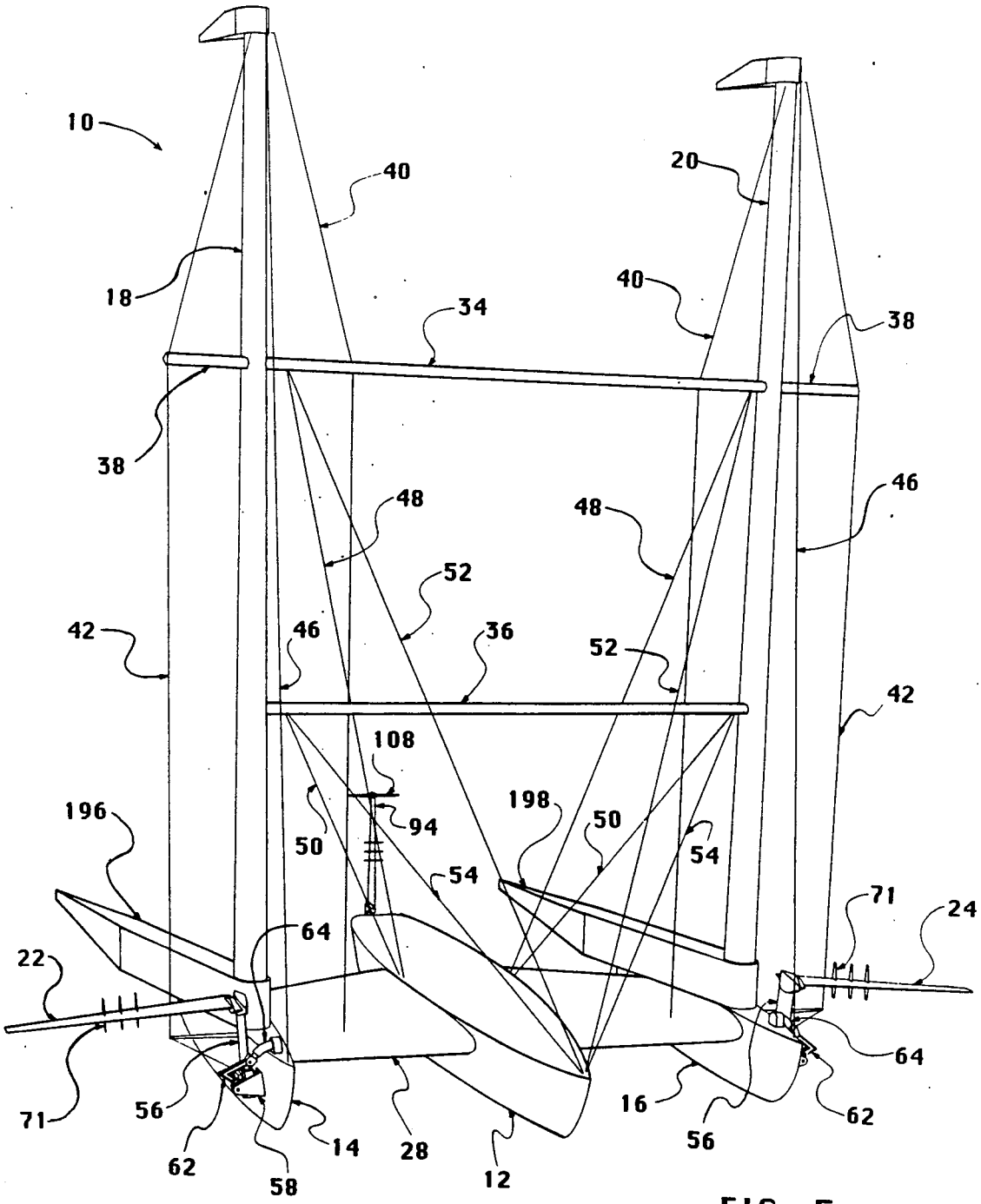
FIG. 5 is a perspective view of the sailing vessel of FIG. 1 in a stowed condition.

It is advisable for the aileron foils 22 and 24 to be lifted completely from the water when the sailing vessel 10 is not in use or when the vessel 10 is traveling through extremely shallow water or through water containing hidden obstructions. To withdraw the ailerons 22 and 24 from the water completely, the piston rods 66 are retracted into the hydraulic cylinders 68 to rotate the support beams 56 upwardly. When the piston rods 66 are extended upwardly between the bases of the mounting brackets 58 and the hinge pins lying on the axes 61, the bell cranks 62 are rotated through substantial arcs to bring the aileron foils 22 and 24 up and out of the water into a stowed configuration, as depicted in FIG. 5. The aileron foils 22 and 24 remain raised and out of the water in this configuration until the sailing vessel 10 is again to be used.

By mounting the aileron foils 22 and 24 on the sponsons 14 and 16 in a rotatable manner such that the aileron foils 22 and 24 are rotatable with the support beams 56, the aileron foils 22 and 24 can be selectively utilized to act efficiently as center boards, as in the deployment depicted in FIG. 3, or as water wings, as depicted in FIG. 2. The aileron foils 22 and 24 can thereby create maximum speed in light to heavy wind sea conditions. Also, when the sailing vessel 10 is operated under motor power, operation of the hydraulic actuator 154 allows the aileron foils 22 and 24 to be set at an optimum angle of attack to allow the sailing vessel 10 to passively find the optimum wetted foil area to achieve the best fuel economy and speed. The angle of attack of the aileron foils 22 and 24 can be increased to raise the vessel 10 above the waves.

Figure 13:
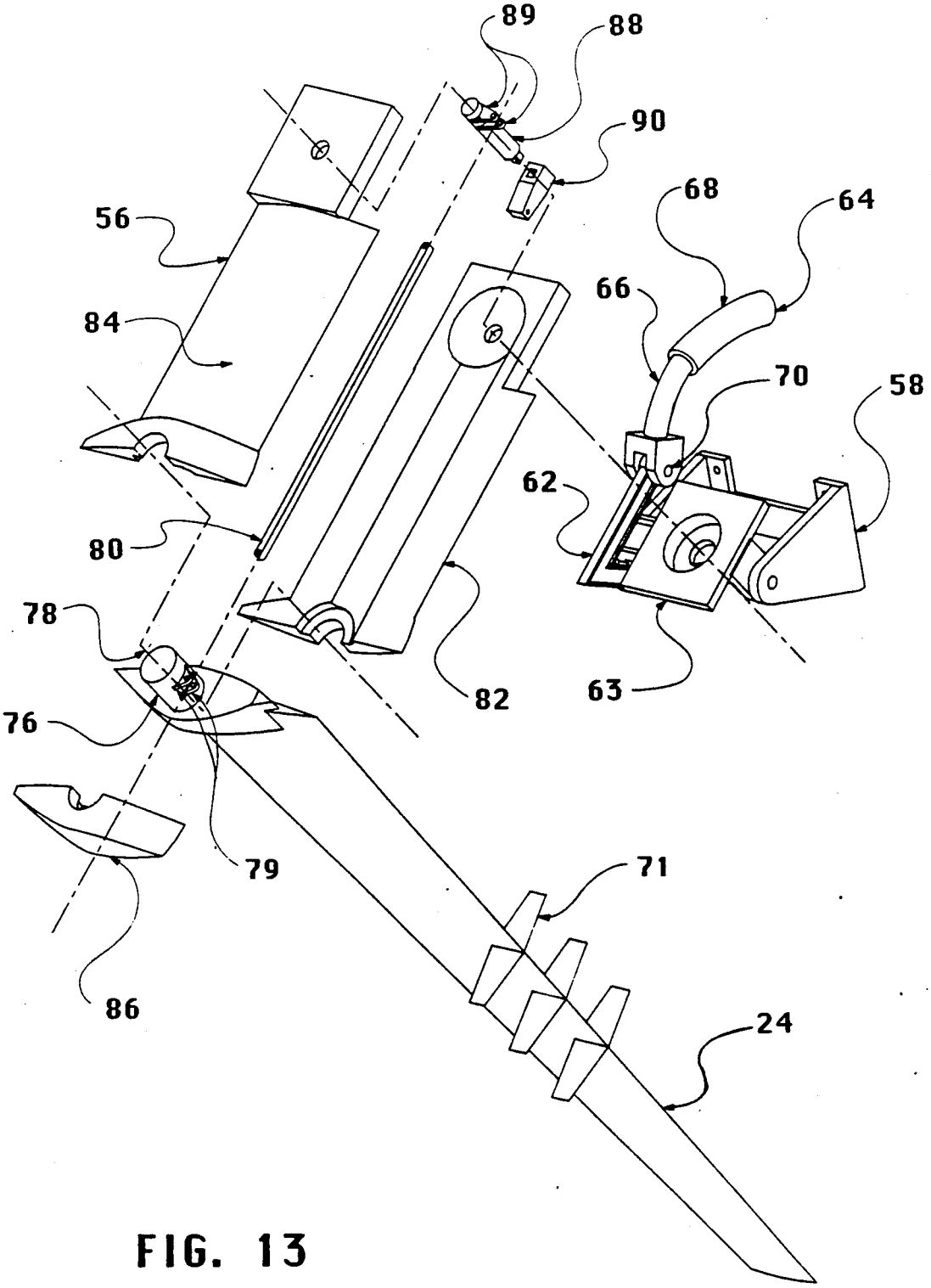
FIG. 13 is an exploded isometric view of an aileron foil of the vessel of FIG. 1.

The internal structure of the aileron assemblies is depicted in FIG. 13. As shown in that drawing figure, each of the aileron foils 22 and 24 is provided with a stub axle 76 that defines an axis of rotation 78 about which the aileron foils 22 and 24 can be rotated relative to the support beams 56. The axes 78 are normally inclined relative to the horizontal when the sailing vessel 10 is in use, as depicted for example in FIGS. 2 and 3. The axes 78 of the aileron foils 22 and 24 are thus inclined downwardly toward each other at an angle controlled by actuation of the hydraulic actuators 64.

Each stub axle 76 is provided with a pair of radially disposed brackets 79 adapted to receive an aileron connecting rod 80 therebetween, as depicted in FIG. 13. The aileron connecting rod 80 extends longitudinally internally within the body of the support beam 56, which is formed with a pair of shell sections 82 and 84 that define an elongated, hollow cavity therewithin. A cap 86 is secured to the ends of the shell sections 82 and 84 to entrap the stub axle 76 within the cavity defined in the support beam 56. The stub axle 76 is free to rotate within the confines of the support beam 56, but is immobilized from longitudinal movement relative thereto. The axes 78 of rotation of the aileron foils 22 and 24 therefore remain fixed and unchanged relative to the support beams 56.

Rotation of the stub axle 76 of each aileron foil is effectuated through the connecting rod 80 by means of a crank cylinder 88 and crank arm 90. The crank cylinder 88 has a pair of radially disposed ears 89 to which the other end of the connecting rod 80 is rotatably secured. The ears 89 of the crank cylinder 88 are entrapped within the cavity defined in the support beam 56.

Figure 10:
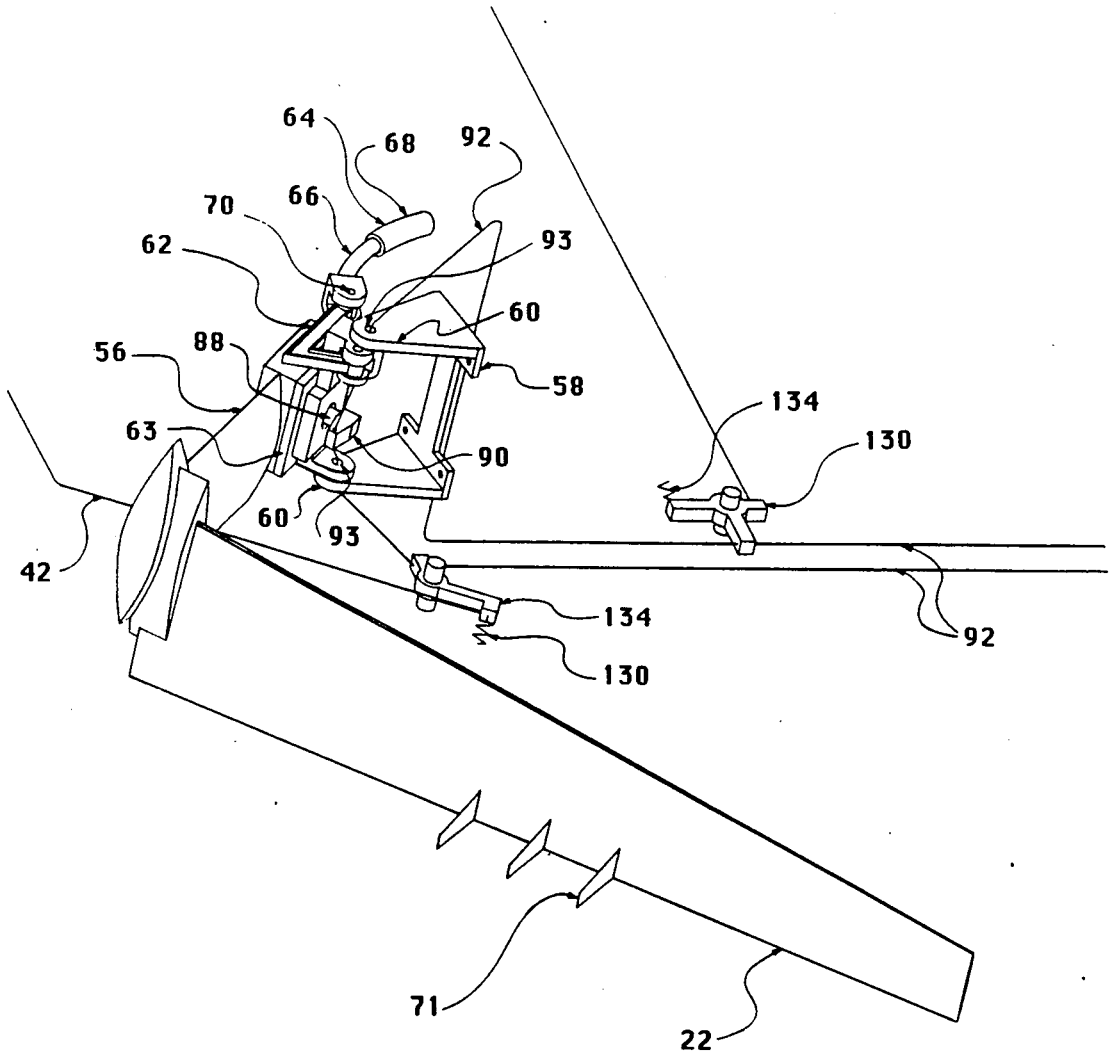
FIG. 10 is an enlarged trimetric view of one of the aileron foils of the vessel of FIG. 1 viewed from one angle.
Figure 11:
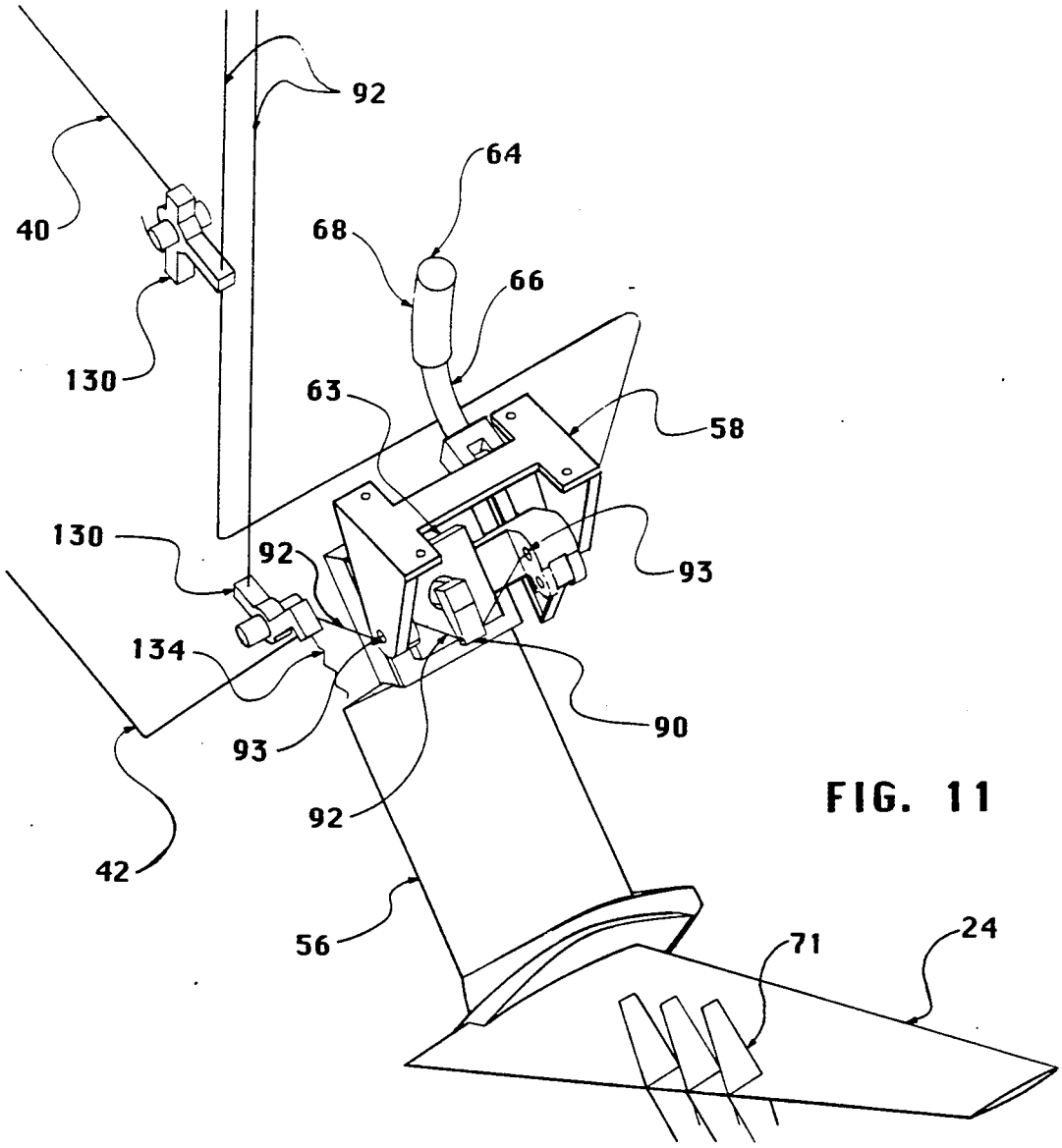
FIG. 11 is an enlarged trimetric view of one of the aileron foils of the vessel of FIG. 1 viewed from a different angle.
Figure 12:
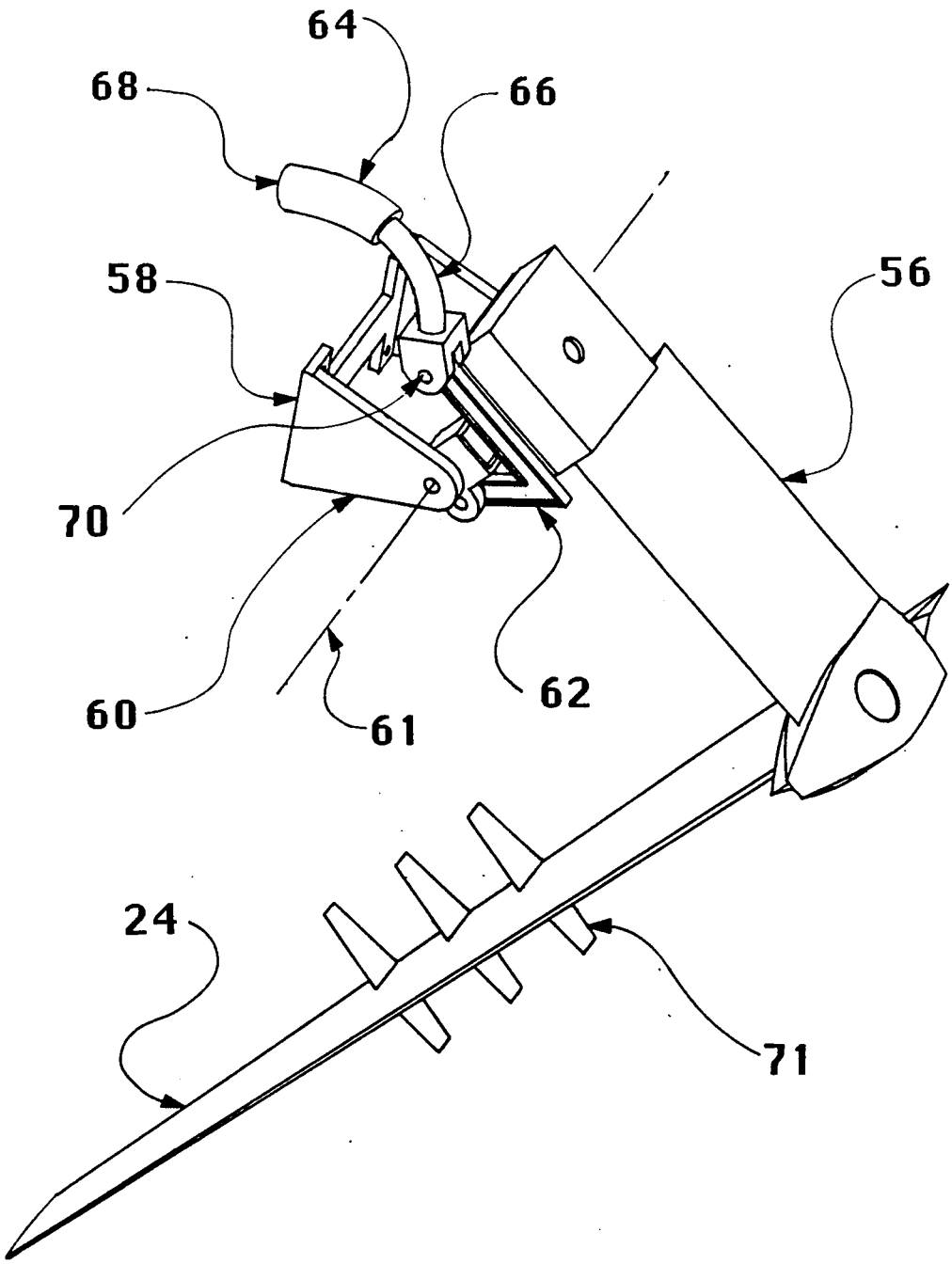
FIG. 12 is an enlarged trimetric view of one of the aileron foils of the vessel of FIG. 1 viewed from yet another angle.

One extremity of the crank cylinder 88 is machined into a stud of square cross section to serve as a key to fit into a corresponding square opening in the crank arm 90. The crank arm 90 is located on the underside of the support beam 56 and beneath the mounting plate 63, as depicted in FIGS. 10 and 11. As best depicted in FIG. 11, the crank arm 90 is rotatable by means of a endless loop cable 92.

Aileron Foil Control

The endless loop cable 92 is clamped within an opening at the tip of the crank arm 90 remote from the crank cylinder 88 so that longitudinal movement of the endless loop cable 92 through openings 93 in the bracket ears 60 will cause the crank arm 90 to turn in rotation. Rotation of the crank arm 90 rotates the crank cylinder 88 that is keyed thereto Rotation of the crank cylinder 88 results in longitudinal movement of the connecting rod 80, which in turn rotates the stub axle 76 and the aileron foils 22 and 24 therewith about the axes 78. Thus, by longitudinally advancing the endless loop cable 92 relative to the mounting brackets 58 the angle of orientation of the aileron foils 22 and 24 about the axes 78 and relative to the support beams 56, and thus the angle of attack of the aileron foils 22 and 24 relative to the water, can be varied.

As illustrated in FIG. 1, the aileron foils 22 and 24 are respectively held in articulated fashion from the sponsons 14 and 16 by the support beams 56. The support beams 56 are mounted on the sponsons 14 and 16 in a rotatable manner. The hydraulic actuators 64 rotate the support beam 56 relative to the sponsons 14 and 16. The aileron foils 22 and 24 are rotatable with the support beams 56 about the axes 61 to allow adjustment of the inclination of the axes 78 about which the aileron foils 22 and 24 are rotatable relative to the support beams 56. The axes 78 lie in a vertical plane that is perpendicular to the orientation of the sponsons 14 and 16 and the central main hull 12.

Rudder

Figure 15:
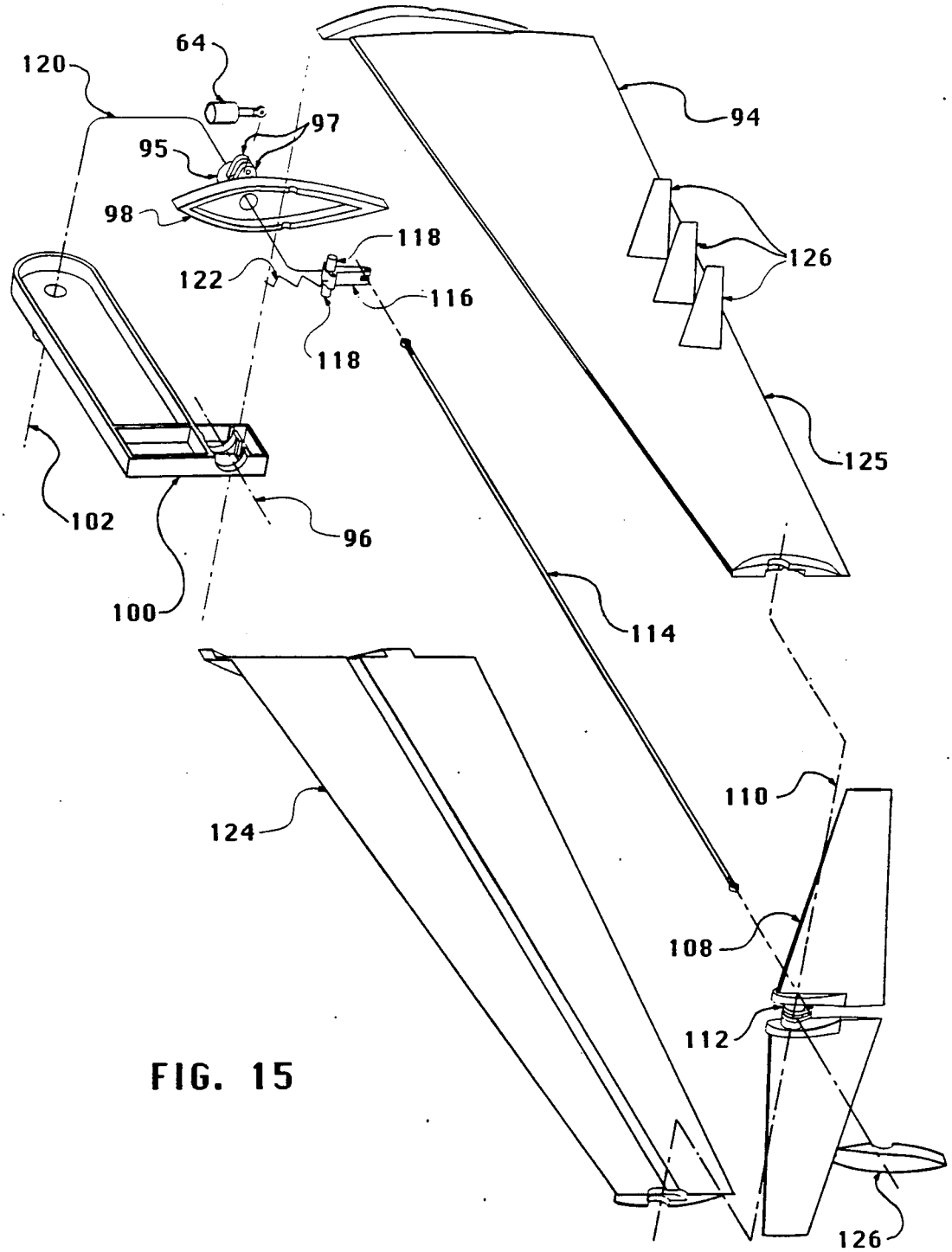
FIG. 15 is an exploded trimetric view of the rudder of FIG. 14.
Figure 16:
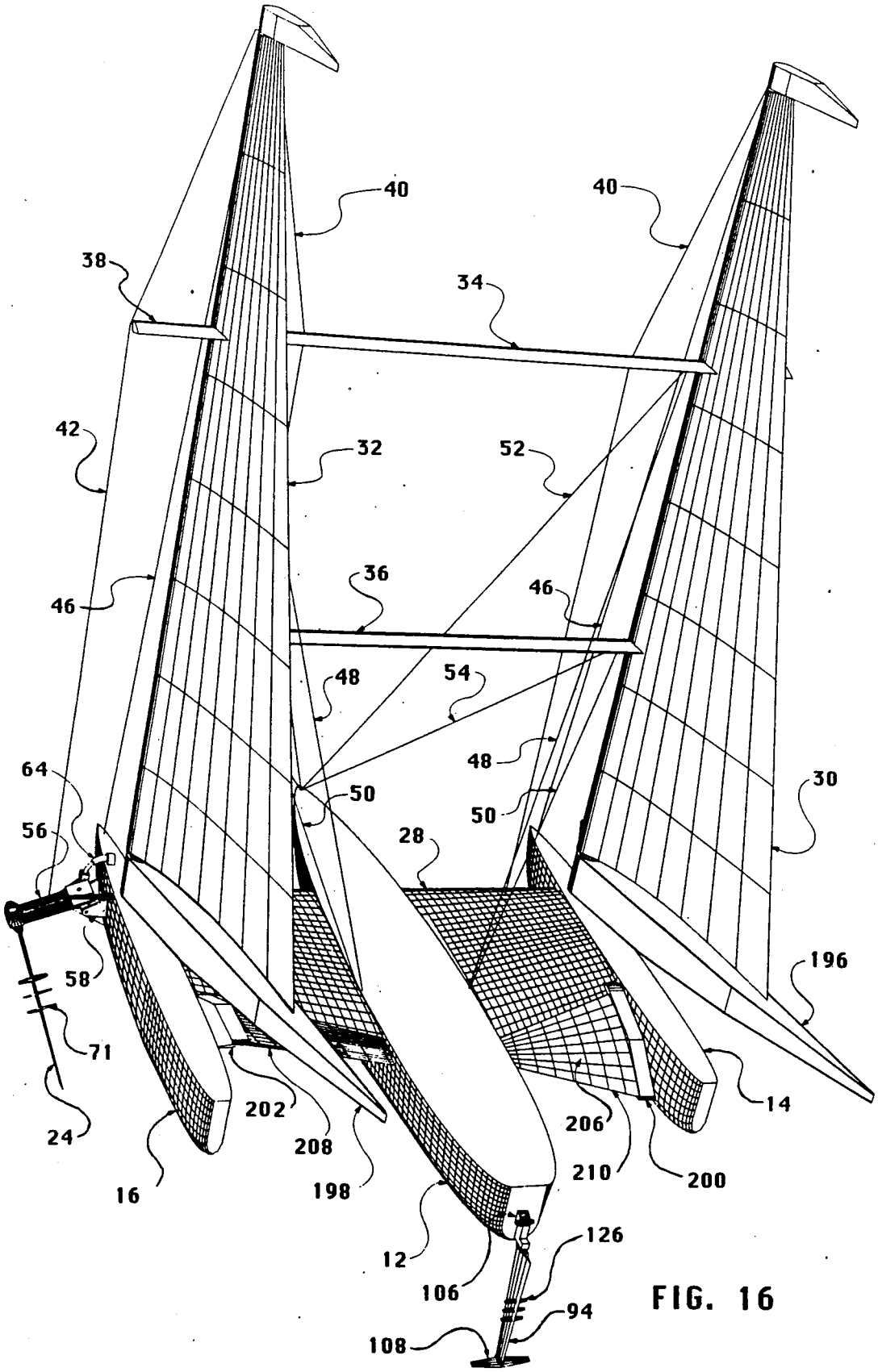
FIG. 16 is a rear perspective view of a modified form of the sailing vessel of FIG. 1 equipped with flaperons.

The sailing vessel 10 also includes a rudder 94 located at the rear of the central main hull 12, as depicted in FIG. 16. The rudder 94 extends downwardly from the central main hull 12 and is rotatable about a vertical rudder post 95, visible in FIG. 15, which has a vertical axis of rotation indicated at 96 in FIG. 14. The rudder 94 is rotated about the axis 96 to steer the sailing vessel 10 in a conventional manner by virtue of torque exerted on the steering collar 98. A hydraulic rudder control means, such as a hydraulic actuator 64, is provided to control rotation of the rudder 94 at the rudder post 95 by means of torque exerted through crank ears 97.

Figure 14:
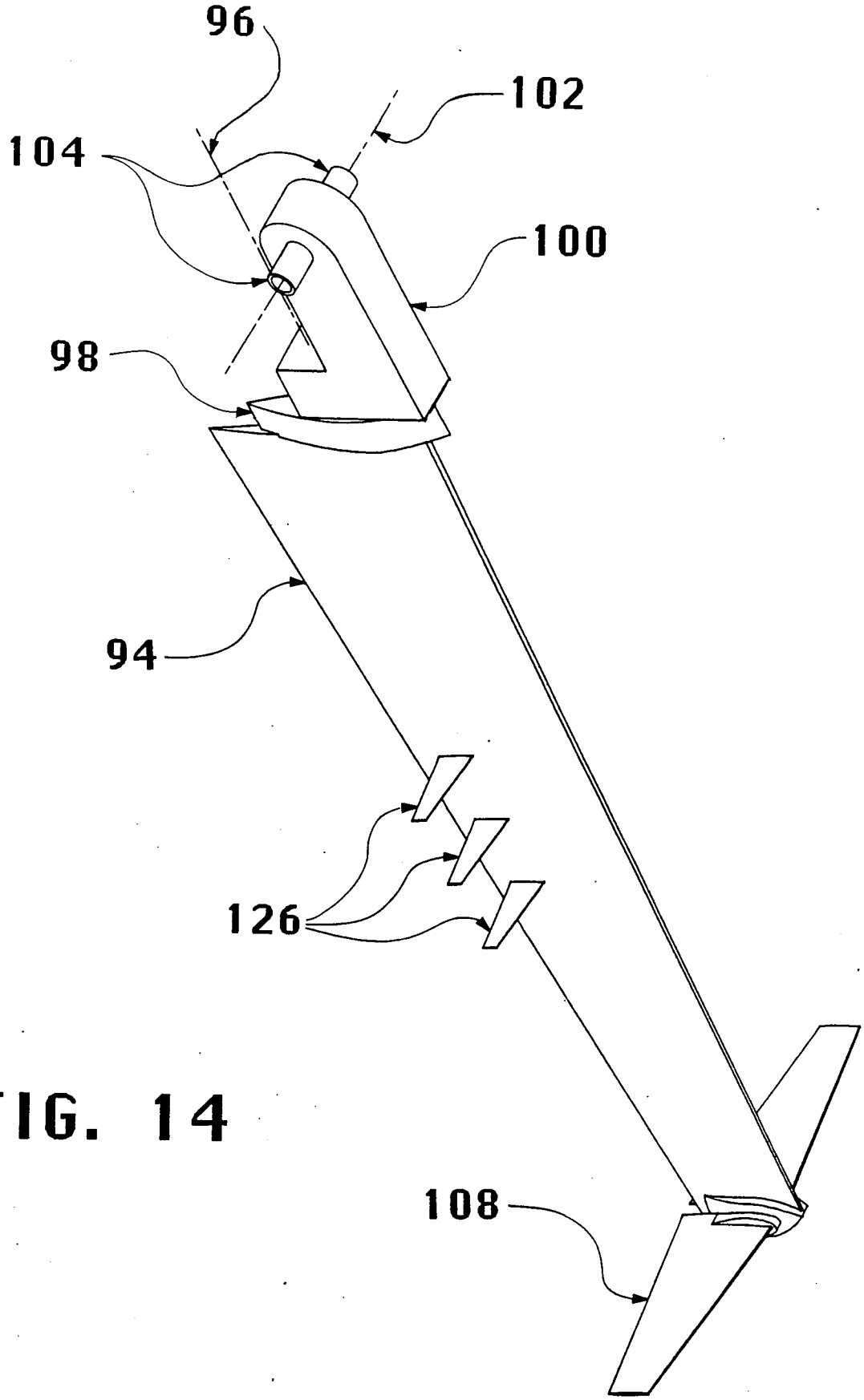
FIG. 14 is a isometric detail view of the rudder of the sailing vessel of FIG. 1.

The rudder 94 is carried on a rudder beam 100, best depicted in FIG. 14. The rudder beam 100 is mounted for rotation about a transverse axis 102 defined by rudder mounting pintles 104. The rudder pintles 104 are carried by a pair of mounting brackets, indicated generally at 106 in FIG. 16, which are located on the transom of the central main hull 12. A hydraulically actuated means, such as a hydraulic actuator 64 of the type previously described, is coupled to rotate the rudder beam 100 about the transverse axis 102 on the transverse hinge formed by the pintles 104 and the brackets 106.

The rudder beam 100 may thereby be rotated upwardly to raise the rudder 94 entirely out of a body of water as depicted in FIG. 5. The rudder beam 100 is normally rotated to the position of FIG. 5 for storage, to avoid submerged objects, and to allow the rudder 94 to be cleaned. When the sailing vessel 10 is in use the rudder beam 100 is rotated downwardly and locked to hold the rudder axis 96 in an upright disposition. The rudder beam 100 is thereby used to alternatively raise and lower the rudder 94 relative to the water in which the central main hull 12 and the sponsons 14 and 16 float.

Elevator Foil

The rudder 94 is equipped with an elevator foil 108 which is disposed transversely relative to the rudder 94 and is mounted to the rudder 94 for rotation about a transverse axis 110, depicted in FIG. 15. At the center of the elevator 108 there is an internally formed axle rod 112 which has a pair of radially projecting ears adapted to receive one extremity of the elevator connecting rod 114. The opposite end of the elevator connecting rod 114 is coupled to a pair of ears on a T-shaped elevator crank link 116 that is rotatably mounted relative to the rudder 94 by means of elevator crank link pintles 118. The T-shaped elevator crank link 116 has one arm coupled to an elevator cable 120. The other arm of the T-shaped elevator crank link is connected to a spring 122. The spring 122 is interposed between the arm of the elevator crank link 116 and the body of the rudder 94. The body of the rudder 94 is formed by a pair of mating shell sections 124 and 125 which are secured together at their lower extremities by a rudder tip 126 and at their upper extremities by the rudder steering collar 98.

The elevator foil 108 is disposed transversely relative to the rudder 94 and is mounted to the rudder 94 for rotation about the transverse axis 110. The spring 122 normally biases the elevator crank link 116 to a position in which the elevator foil 108 resides in a disposition where the angle of attachment of the foil balances the weight of the boat. That is, as the vessel moves faster this angle decreases thereby maintaining a constant lift. Increased tension on the elevator cable 120 will superimposes a force to overcome the tensile bias of the spring 122 and will cause the elevator crank link 116 to rotate upwardly about the pintles 118, thereby drawing upwardly on the elevator connecting rod 114. Upward translational movement of the elevator connecting rod 114 rotates the elevator axle 112 to raise the trailing edge of the elevator foil 108 relative to the transverse axis 110. Conversely, relaxation of tension on the elevator cable 120 allows the spring 122 to contract to counter-rotate the elevator crank link 116 downwardly. This causes the elevator connecting rod 114 to move in translation downwardly, thereby counter-rotating the elevator foil 108 to lower the trailing edge thereof.

The rudder 94 is also equipped with transversely projecting passive pitch foils 126 which are located above the elevator foil 108 on the rudder 94. The small passive pitch foils 126 are fixedly secured to both of the shell sections 124 and 125 to project laterally from both sides of the rudder 94 in fixed orthogonal orientation relative thereto. The passive pitch foils 126 aid in positioning the stern of the central main hull 12 out of the water and also serve to counteract any non-proportional pitch moment loads. The small passive pitch foils 126 are located one above another in a ladder-type arrangement in vertical alignment with each other and with the elevator foil 108. The small passive pitch foils 126 project laterally from both of the rudder sections 124 and 125. Like the passive pitch foils 71, the passive pitch foils 126 affect the load sensing and foil control means by compensating for error and inertial forces.

Load Sensing and Foil Control

The operation of the load sensing and foil control means 26 may best be described with reference to FIGS. 6, 7, 11 and 15. The load sensing and foil control system 26 is comprised of rotational driving mean for each of the aileron foils 22 and 24, as well as a rotational driving means for the elevator foil 108. The rotational driving system for the aileron foils 22 and 24 includes the mechanical linkage that exists from the endless loop cable 92, through the crank arm 90, the crank cylinder 88, the connecting rod 80 and the stub axle 76, depicted in FIGS. 11 and 13. Longitudinal advancement of the endless loop cable 92 to rotate the crank arm 90 in either of the two opposite directions of rotation turns the aileron foils 22 and 24 in rotation about their respective axes 78. As illustrated in FIG. 7, the endless loop cable 92 is connected through a system of pulleys 128 so that longitudinal advancement of the endless loop cable 92 turns the aileron foils 22 and 24 in counter-rotation relative to each other.

Figure 9:
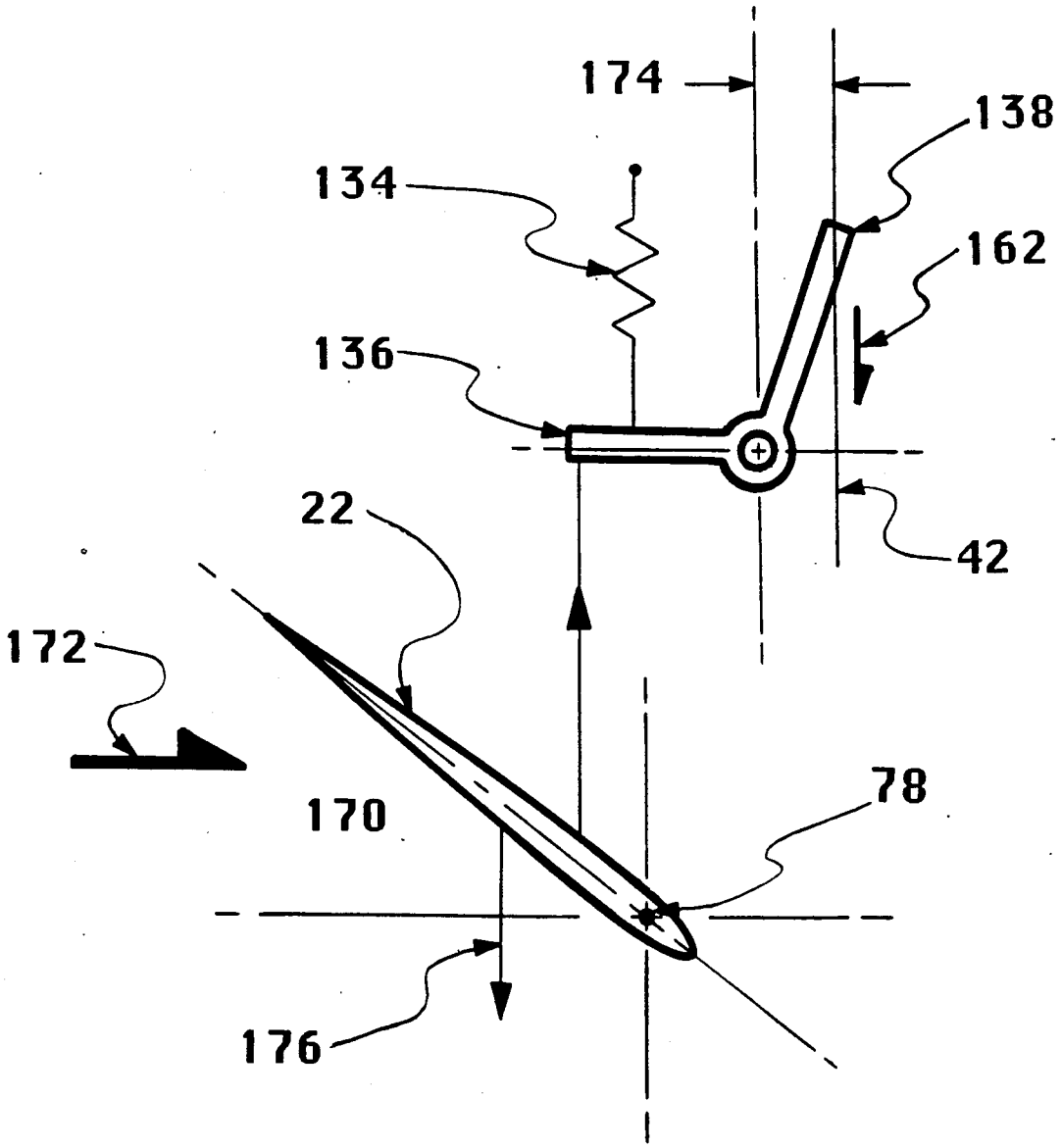
FIG. 9 is a force diagram useful in explaining the operation of the aileron foils of the vessel of FIG. 1.

The load sensing and foil control means 26 also includes proportional load transducers 130, which are depicted in FIGS. 6, 7 and 9. Separate ones of the proportional load transducers 130 are coupled between the inboard upper shrouds 40 and outboard upper shrouds 42 and the aileron rotation actuating means, which is the endless loop cable 92 and the mechanical linkage coupled thereto and to the aileron foils 22 and 24. The proportional load transducers 130 are each comprised of a bell crank 132 that is mounted for rotation relative to the hull system. Specifically, the bell crank 132 of the proportional load transducers 130 that are connected to the inboard upper shrouds 40 are rotatably mounted within the monocoque bridge 28. In a similar manner the bell cranks 132 of the proportional load transducers 130 that are coupled to the upper outboard shrouds 42 are rotatably mounted within the sponsons 14 and 16. Each of the proportional load transducers 130 transmits a fraction of the load in the shroud to which it is connected to the aileron actuating endless loop cable 92.

One arm of each of the bell cranks 132 is connected to the endless loop cable 92. The same arm of each bell crank 132 is coupled to an extremely heavy coil spring that is anchored relative to the hull system. Specifically, the springs 134 of the proportional load transducers 130 that are coupled to the upper inboard shrouds 40 are anchored between the monocoque bridge 28 and the arm 136 of the bell crank 132 to which the endless loop cable 92 is connected. The arms 138 of those same bell cranks 132 are connected to the upper inboard shrouds 40.

In a similar manner, the outboard upper shrouds 42 are connected to the arms 138 of the bell cranks 132 that are mounted for rotation in the sponsons 14 and 16. The other arms 136 of those bell cranks 132 are anchored by springs 134 to the structure of the sponsons 14 and 16. The arms 136 of those same bell cranks 132 are also coupled to the endless loop cable 92.

The proportional load transducers 130 are connected to the endless loop cable 92 in such a way that the fractional portions of the shroud loads transmitted thereto from the upper inboard shrouds 40 and the upper outboard shrouds 42 are additive for any direction of wind relative to the sails 30 and 32. That is, as long as the wind acts in the same direction against both of the sails 30 and 32 the proportional forces derived from the proportional load transducers 130 will all act to cause the endless loop cable 92 to advance in the same direction. Since the aileron foils 22 and 24 are coupled to move in counter-rotation relative to each other, the effects on the angle of attack will be opposite as between the two ailerons 22 and 24.

Manual Aileron Foil Adjustment

Figure 8:
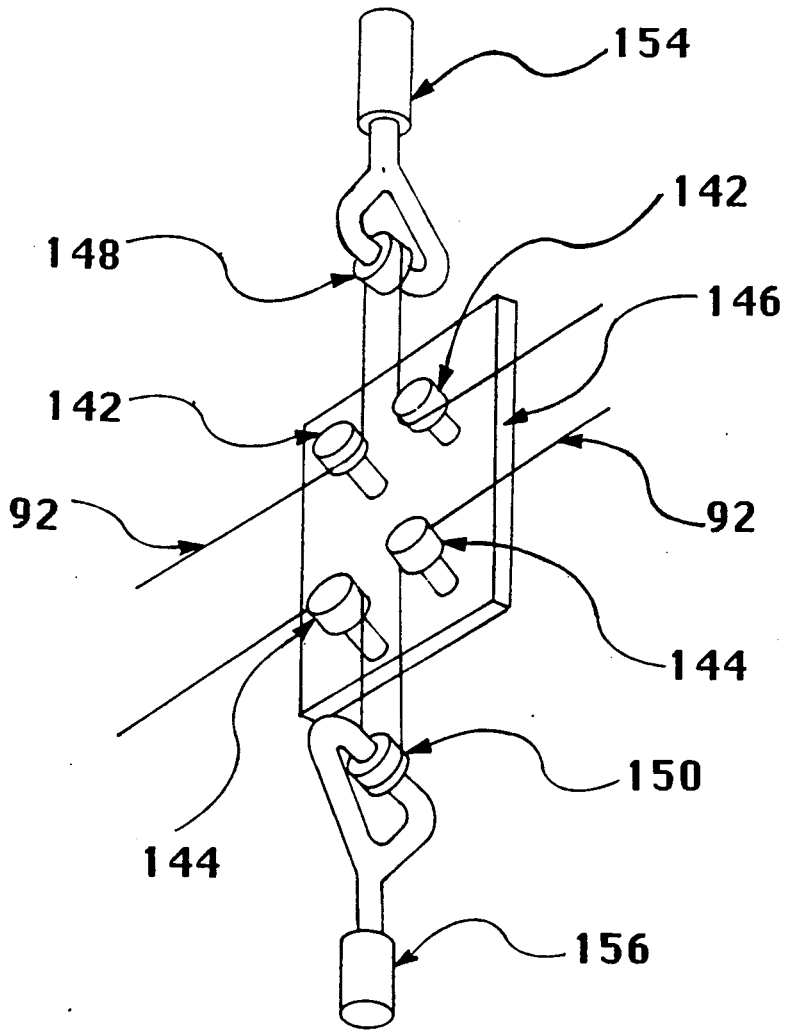
FIG. 8 is a isometric detail view showing the manual adjustment mechanism for the load sensing and foil control means of FIG. 7.

Since some of the forces acting on the shroud systems are not precisely proportional, it is advisable to provide the load sensing and foil control means 26 with a manually operable cable advancement adjustment apparatus 140, which is depicted in detail in FIG. 8. The manual advancement adjustment apparatus 140 is comprised of a pair of turning blocks 142 and another pair of turning blocks 144 mounted on a supporting base 146. The apparatus 140 also includes trim pulleys 148 and 150. The trim pulleys 148 and 150 are connected to hydraulic actuators 154 and 156, respectively. The endless loop cable 92 passes over the turning blocks 142 and about the trim pulley 148 and also over the turning blocks 144 and about the trim pulley 150.

If the hydraulic cylinder 154 is actuated to pull upwardly on the trim pulley 148 to exert tension on the endless loop cable 92, the set point positions of the aileron crank arms 90 will be adjusted in one direction of rotation relative to the mounting plates 163. Alternatively, if the hydraulic actuator 156 is actuated to pull downwardly on the trim pulley 150, tension will be exerted in the opposite directions on the endless loop cable 92. The aileron crank arms 90 will then be rotated in the opposite direction relative to the mounting plates 163 to a new set point position. The manually operable cable advancement adjustment apparatus 140 is thereby coupled to the endless loop cable 92 in series with the proportional load transducers 130 to allow manual adjustment of advancement of the endless loop cable 92.

The trim pulleys 148 and 150 in the loop formed by the endless loop cable 92 serve as a manually operable cable adjustment system 140 that controls the set point or null setting of the angle of attack of the aileron foils 22 and 24. The manually operable cable adjustment system 140 compensates for the weight of the sailing vessel 10 is used to raise or lower the sailing vessel 10 out of the water when it is under sail, thereby acting as a speed brake. Upward tension on the trim pulley 148 by means of the hydraulic actuating cylinder 154 tends to raise the aileron foils 22 and 24 and the vessel out of the water. Conversely, downward tension on the lower trim pulley 150 tends to hold the aileron foils 22 and 24 and the sailing vessel 10 in the water.

With reference to FIGS. 2 and 7, wind acting upon the sailing vessel 10 from the left of those drawing figures will exert a directional force indicated by the directional arrow 158. When the wind blows in the direction 158 across the port side of the sailing vessel 10, the force of the wind in the sails 30 and 32 will tend to cause the vessel 10 to heel to leeward and move sideways. Also, the forward movement of the aileron foils 22 and 24 through the water will produce a hydrodynamic lifting force on the sides of the aileron foils 22 and 24. That is, a lifting force will act on the upper surface of the aileron foil 22 and upon the lower surface of the aileron foil 24. This lifting force acts to reduce the extent of heeling to leeward of the sailing vessel 10 and resist sideways movement.

The magnitude of the lifting forces on the aileron foils 22 and 24 is controlled by the angle of attack of the aileron foils 22 and 24 through the water. As the velocity of the wind 158 increases, the speed of the sailing vessel 10 will also increase, thereby tending to increase the heeling force. To counter balance this force the trailing edge of the windward aileron foil is rotated upwardly and the trailing edge of the leeward aileron foil is rotated downwardly, thereby stabilizing the sailing vessel.

The force required to change the angle of attack of the aileron foils 22 and 24 is created by the force provided through the proportional load transducers 130, as depicted in FIG. 7. That is, with the wind velocity in the direction 158 blowing in over the port side of the sailing vessel 10, an increase in wind velocity requires the trailing edge of the aileron foil 22 to be rotated downwardly and for the trailing edge of the aileron foil 24 to be rotated upwardly, thereby stabilizing the vessel 10 as it moves through the water. These forces are created by the increase in forces transmitted through the outboard upper shroud 42 of the mast 20 and by the increased force transmitted through the inboard upper shroud 40 of the mast 18. These increased forces are indicated by the directional arrows 160 in FIG. 7. At the same time, the forces on the leeward inboard upper shroud 40 of the mast 20 and the leeward outboard upper shroud 42 of the mast 18 are reduced. These forces are indicated by the directional arrows 162 in FIG. 7.

When the forces 160 are increased and the forces 162 are reduced, a portion of the increased forces 160 and reduced forces 162 is transmitted to the endless loop cable 92 through the proportional load transducers 130. As viewed in FIG. 7, this results in a longitudinal translation of the endless loop cable 92 in the direction indicated by the directional arrows 164. Translation of the endless loop cable 92 in the direction indicated by the directional arrows 164 in FIG. 7 is transmitted as a torque acting on the aileron crank arm 90 which tends to raise the trailing edge of the aileron foil 24, as viewed in FIG. 2, and lower the trailing edge of the aileron foil 22 as viewed in FIG. 2. Thus, the forces required to change the angle of attack of the aileron foils 22 and 24 to counter balance the dynamic changes in wind velocity are automatically created by forces transmitted through the rigging of the sailing vessel 10. Specifically, these forces are automatically created by the forces transmitted through the inboard and outboard upper shrouds 40 and 42.

When the wind blows in the opposite direction indicated by the directional arrows 166 in FIG. 7, precisely the reverse situation exists. That is, with an increase in wind velocity in the direction indicated by the directional arrow 166 in FIG. 7, the forces 162 will increase and the forces 160 will decrease. This will result in a proportional change in forces transmitted to the endless loop cable 92, thereby resulting in longitudinal translational movement of the endless loop cable 92 in the directions indicated by the directional arrows 168 in FIG. 7. In this situation the increased hydrodynamic forces created by rotating the trailing edge of the windward aileron foil 22 upwardly and the trailing edge of the leeward aileron foil 24 downwardly are opposed by the increased aerodynamic forces derived from the increased velocity of the wind. These forces are indicated by the directional arrows 162 which are transmitted as forces on the endless loop cable 92 indicated by the directional arrows 168.

The automated aileron foil control system of the invention also acts to stabilize the sailing vessel 10 and to reduce the amount of heeling by feedback. As indicated in the force diagram of FIG. 9, and considering the aerodynamic foil 22 to be the windward foil and illustrating diagrammatically only the force 162 acting on the outboard upper shroud 42 of the mast 18. A heeling moment on the vessel causes a portion of the foil 22 to be raised out of the water thereby causing a clockwise rotation of the foil 22 about the axis of rotation 78. This occurs because the surface area of contact between the foil and the water is reduced. Such a rotation tends to increase the angle 170 which the foil 22 makes with the vector of velocity of movement of the foil 22 through the water. The direction of velocity of movement of the foil 22 through the water is indicated by the directional arrow 172. With the force 162 remaining constant, a clockwise rotation of the foil 22 about the axis of rotation 78 results in a clockwise rotation of the bell cranks 132. The force 162 thereupon acts as a greater moment because the moment arm 174 has increased. This increased clockwise moment becomes larger than the opposing moment of the spring 134 on the bell cranks 132. As a result, the force 176 increases thus causing the foil 22 to be lowered back into the water, thereby reducing heeling of the vessel 10. The configuration of the inclined aileron foils and the proportional load transducers 130 coupled thereto, minimizes the chance that the windward foil will become unsubmerged which could cause dangerous and uncontrolled roll of the vessel at high speeds.

The load sensing and pitch control means 26, depicted in FIGS. 6 and 15, is also comprised of a pair of proportional load transducers 178 located on opposite sides of the central main hull 12 on the outboard sides thereof approximately midway between the bow and the stern. The forces are transmitted from the shroud system of the masts 18 and 20 through the upper aft stays 48. The proportional load transducers 178 are identical in construction to the proportional load transducers 130. Aft link cables 180 are connected to the proportional load transducers 178 and extend from the proportional load transducers 178 toward the stern of the central main hull 12 internally therewithin. The aft link cables 180 are joined together and merge into a common elevator cable 120 that is attached to the proportional load transducer 116. The proportional load transducer 116 is connected, in turn to the elevator connecting rod 114 that is attached to the elevator foil 108.

As shown in FIG. 1, the configuration of the upper and lower transverse struts 34 and 36 that extend between the masts 18 and 20 and the upper and lower stays 48, 50, 52 and 54 creates a structural design that is simple and allows a very direct load path between the sails 30 and 32 and the aileron foils 22 and 24 and the elevator foil 108. This is a necessary feature because the sailing vessel 10 moves at a far higher speed than normal sailboats, and therefore generates much larger forces.

When there is a load on the sails 30 and 32, there is a tendency for the stern of the sailing vessel 10 to be lifted out of the water by a pitch moment. This force on the sails 30 and 32 is transmitted to the separate shroud systems of the masts 18 and 20 and results in increased tensile forces in the aft shrouds 48. By transmitting a portion of the increased forces in the aft shrouds 48 to the elevator foil 108, the elevator foil 108 is rotated proportionally so as to counteract the forward pitching force. A reduction in the forces on the aft stays 48 results in counter-rotation of the elevator foil 108.

The use of the three foils, namely the aileron foils 22 and 24 and the elevator foil 108, allows smaller sponsons 14 and 16 to be utilized. This allows for greater room in the central main hull 12 without increasing the overall weight of the craft, while eliminating drag caused by spray of an additional fourth foil passing through the surface of the water.

Each of the separate shroud means for the masts 18 and 20 is comprised of at least one aft stay 48. The aft stays 48 are upper aft stays connected to the masts 18 and 20 at the upper transverse stabilizing strut 34. Preferably each shroud system is provided with a lower aft stay 50 as well. The lower aft stays 50 are connected to the lower transverse stabilizing strut 36.

The aft stays 48 and 50 lead from the masts 18 and 20 and are connected to the proportional load transducers 178. The proportional load transducers 178 are located on the outboard sides of the central main hull 12 about midway between the bow and stern. From the proportional load transducers 178 a pair of aft link cables 180 extend rearwardly within the structure of the central main hull 12 and are joined together and to a single elevator cable 120 in the stern of the central main hull 12. The elevator cable 120 is thereby linked between the proportional load transducers 178 and the proportional load transducer 116 in the rudder 94. The aft stays 48 which lead from the masts 18 and 20 are thereby connected to both the proportional load transducers 178 and to the proportional load transducer 116. This load transducing system forms a load sensing and pitch control means that is coupled to both of the separate shroud systems and to the elevator foil 108 to rotate the elevator foil 108 about the transverse elevator axis 110 in response to loads on the upper aft stays 48.

Figure 18:
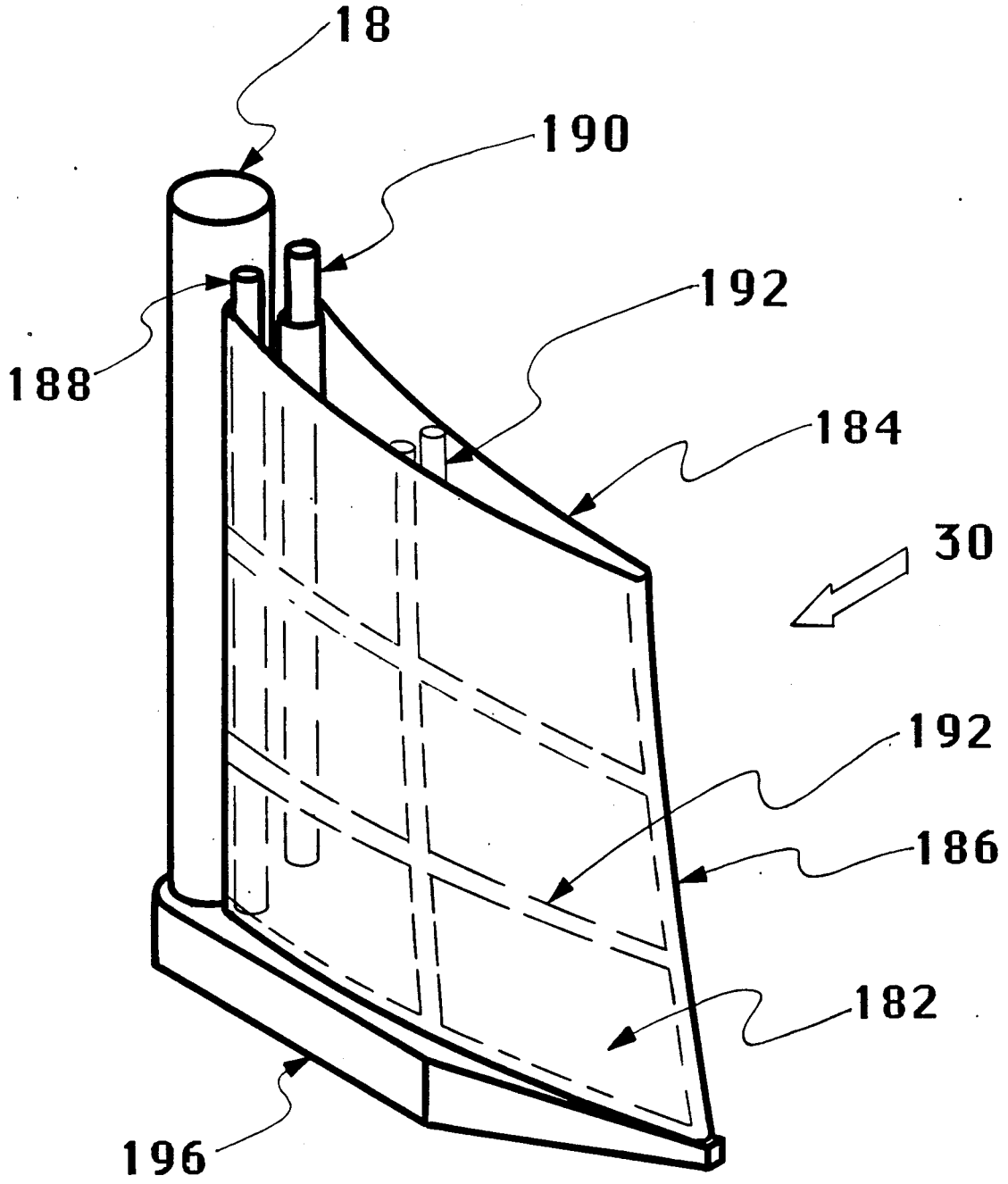
FIG. 18 is a trimetric view of a preferred form of sail construction for use in a sailing vessel according to the invention.

The sails 30 and 32 are both wing sails and are of identical construction. The construction of the sails 30 and 32 is also unique and is illustrated in FIG. 18, which is a cutaway perspective view of a portion of the wing sail 30.

Each wing sail is comprised of a pair of nylon or kevlar sailcloths 182 and 184 which are joined together at a common leech 186. A pair of upright rollers 188 and 190 are located adjacent to and extend the entire length of each of the masts 18 or 20. Each of the sailcloths 182 and 184 is secured to a separate one of the rollers 188 and 190. The rollers 188 and 190 are rotatable together by means of manually controlled hydraulically actuated means (not illustrated) to turn in counter-rotation to selectively lighten and loosen the sailcloths 182 and 184. Tightening and loosening of the sailcloths 182 and 184 selectively adjusts the area and the aspect ratio of the sails.

Preferably, the sail cloths 182 and 184 are both provided with a reinforcing webbing 192 which is secured to the inside surfaces of the sail cloths 182 and 184. The webbing 192 may be formed of a grid of fiberglass filaments sewn onto the inside surface of the sailcloths 182 and 184. The webbing 192 aids in carrying some of the load from the wind into the masts 18 and 20 and to the sail booms 196 and 198. The foot of each of the sails 30 and 32 can be loosened relative to the booms 196 and 198 so that the sailcloths 182 and 184 can be completely rolled up onto the vertically oriented rollers 188 and 190 when the sailing vessel 10 is docked, or during a storm, as illustrated in FIG. 5.

Figure 17:
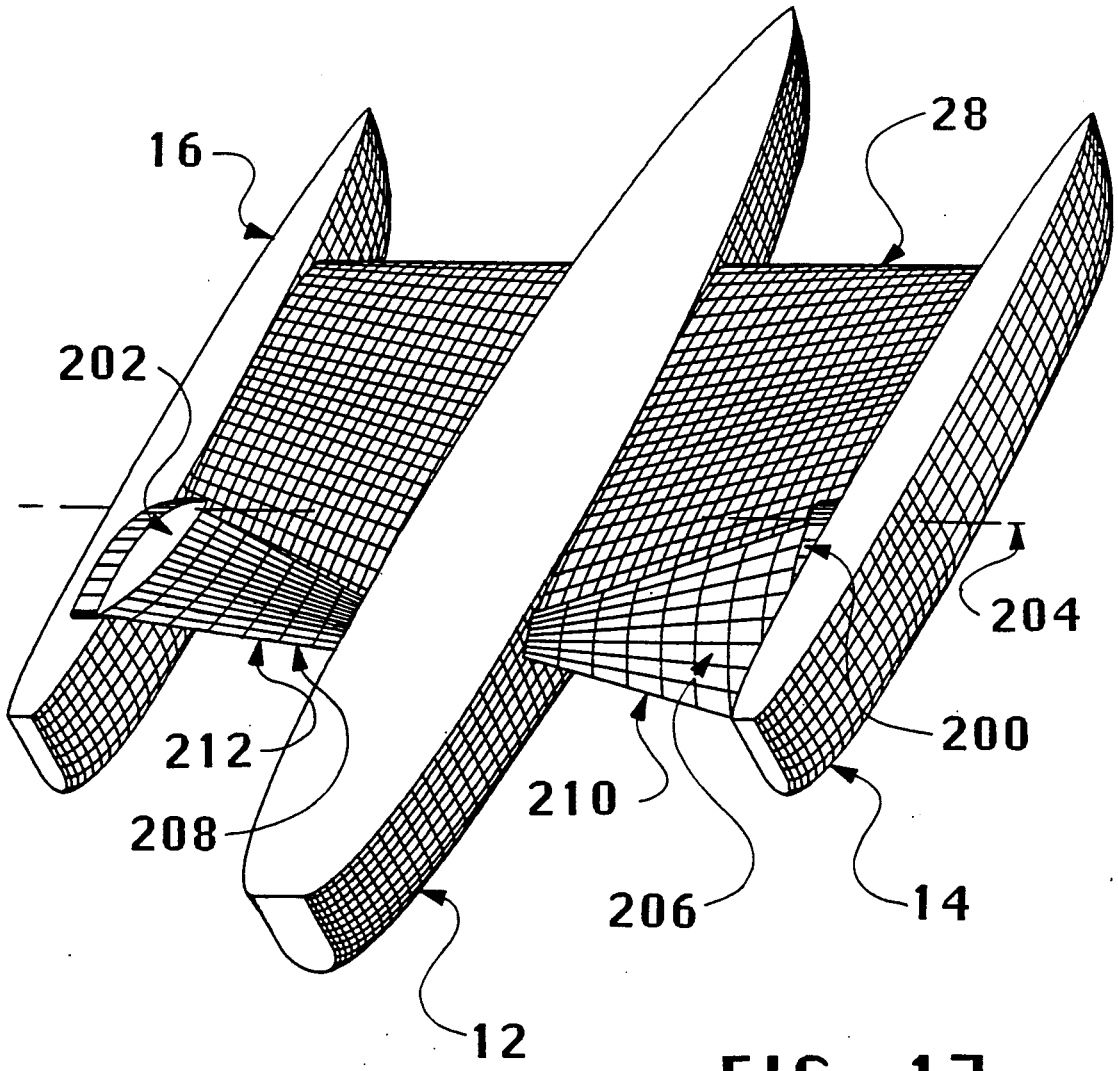
FIG. 17 is a trimetric detail of the hull of the sailing vessel of FIG. 16.

As illustrated in FIGS. 16 and 17, a pair of flaperon booms 200 and 202 extend rearwardly from the monocoque bridge 28 adjacent each of the sponsons 14 and 16, respectively. The booms 200 and 202 are rotatable about the transverse boom axis 204 where they meet the bridge 28. The booms 200 and 202 are rotatably mounted on the sponsons 14 and 16, respectively, for rotation about the axis 204 by means of conventional axle connections which are not visible in the drawings. The booms 200 and 202 are thereby rotatable about the transverse axis 204 where they meet the monocoque bridge 28. Flexible sheets 206 and 208 of nylon or kevlar material extend from the booms 200 and 202, respectively, across the rear of the monocoque bridge 28 to the central main hull 12. The booms 200 and 202 and the flexible sheets 206 and 208 are attached to the central main hull 12 and together form a pair of flaperons 210 and 212. The flaperons 210 and 212 are rotatable about the boom axis 204 so that they are vertically adjustable relative to the sponsons 14 and 16.

While the sailing vessel 10 is in motion, the booms 200 and 202 are rotated alternatively up and down, and in counter-rotation relative to each other, to selected positions by means of conventional manually controlled hydraulic actuators, not illustrated in the drawings. FIG. 17 illustrates the hull of the sailing vessel 10 with the boom 202 of the port flaperon 212 rotated upwardly and with the boom 200 of the starboard flaperon 210 rotated downwardly. The flaperons 210 and 212 will be rotated to the dispositions depicted in FIG. 17 when the wind blows from left to right across the port sponson 16 toward the starboard sponson 14, as depicted in FIG. 17, when the vessel 10 moves under sails.

The boom of the windward flaperon is always rotated upwardly, while the boom of the leeward flaperon is always rotated downwardly. The use of the flaperons 210 and 212 in this manner takes advantage of the ground effect that creates large lift to drag ratios. The flaperons 210 and 212 also produce an efficient roll moment that assists the aileron foils 22 and 24 in resisting heeling.

Because the flaperons 210 and 212 aid the aileron foils 22 and 24 in resistance to heeling, the hydraulic actuators 64 that are connected to the support beams 56 can be actuated to draw the aileron foils 22 and 24 upwardly, as for example, from the disposition of FIG. 2 to the disposition of FIG. 3. By actuating flaperons and by increasing inclination of the aileron foils 22 and 24 the submerged area of the foils 22 and 24 is decreased by raising the vessel higher. This assists in avoiding waves and creates less drag in heavy wind and sea conditions. The flaperons 206 and 208 use the existing bridge structure 28 to add a passive roll stability that is not effected by waves.

Figure 19:
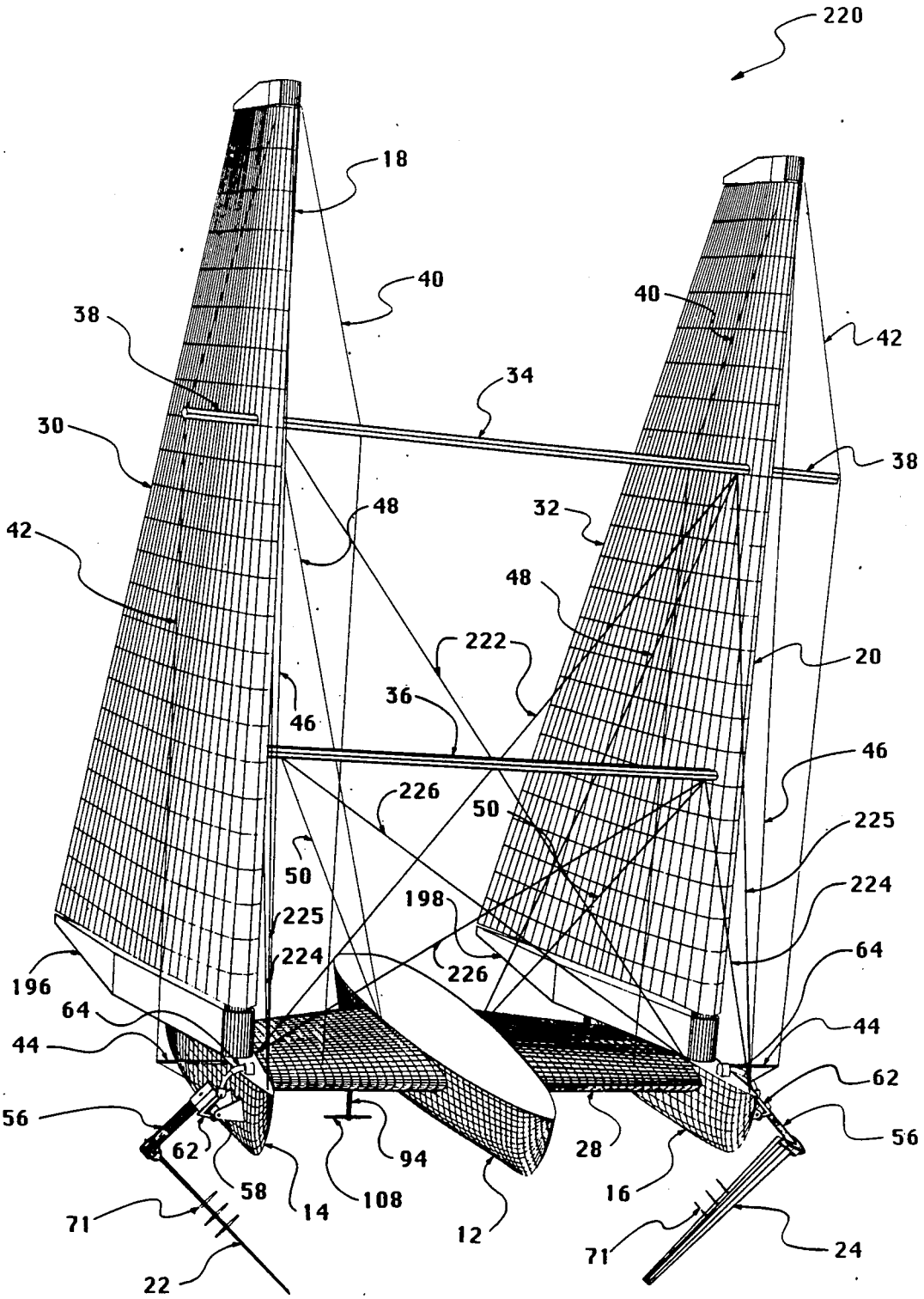
FIG. 19 is a perspective view of an alternative embodiment of the sailing vessel of the invention.

FIG. 19 illustrates an alternative embodiment of a sailing vessel according to the invention. FIG. 19 illustrates a sailing vessel 220 having many of the same features as the sailing vessel 10. These common features are indicated by the same reference numbers employed in the description of the embodiment of FIG. 1. In the sailing vessel 220, however, there are some differences.

In the embodiment of FIG. 19 each of the separate shroud systems in each of the masts 18 and 20 is comprised of a cross stay 222 that extends from the mast mounted on one sponson at the upper transverse stabilizing strut 34 to the base of the mast mounted on the opposite sponson. That is, one of the cross stays 222 extends from the mast 18 at the upper transverse stabilizing strut 34 to the base of the mast 20. The other cross stay 222 extends from the mast 20 at the upper stabilizing strut 34 to the base of the mast 18. The sailing vessel 220 also includes lower cross stays 226 that extend from the lower transverse stabilizing strut 36 adjacent each mast to the base of the opposite mast. The cross stays 222 and 226 are connected to proportional load transducers which are coupled to the endless loop cable in the same manner as the inboard upper shrouds 40 and 46 thereby acting a load sensors.

The shroud systems of the masts 18 and 20 of the sailing vessel 220 are also comprised of lower and intermediate forestays 224 and 225, as well as the upper forestays 46 that extend from each mast to the bow of the sponson upon which the mast is mounted. The lower forestays 224 extend from the masts 18 and 20 at the lower transverse stabilizing strut 36 and 34 to the bows of the sponsons 14 and 16. The intermediate forestays 225 extend from the masts 18 and 20 at the upper stabilizing strut 34 to the bows of the sponsons 14 and 16.

In both of the sailing vessels 10 and 220 the upper and lower aft stays 48 and 50 are both coupled to a common proportional load transducer 178. The upper and lower aft stays 48 and 50 of the sailing vessel 220 extend directly to a single common proportional load transducer 178 located at the stern of the central main hull 12. The sailing vessel 220 thereby does not employ the aft link cables 180 described in association with the sailing vessel 10.

The shroud system of the sailing vessel 220 is more complex than that of the sailing vessel 10 and has an increased cost. However, it more accurately senses load conditions in the sails. Also, because of the direct load paths, it is structurally more efficient.

Since the sailing vessel of the invention does travel at such a high rate of speed, serious damage and injury can occur if one of the aileron foils 22 or 24 strikes a submerged or partially submerged object, such as a reef or a log, and then shears off. If the windward aileron foil were to shear off, the loss of the foil would remove the counterbalancing force tending to prevent the craft from rolling over. As a consequence, the sailing vessel would, in all likelihood, violently roll to leeward. This could result in severe damage to the craft or injury to its occupants. Furthermore, the loss of an aileron foil far out at sea would render the vessel helpless. Also, the impact of an aileron foil against a submerged object would likely be transmitted through the support beam upon which the foil is mounted and tear the aileron foil and support beam away from the sponson on which it is mounted, thereby seriously damaging the sponson.

Figure 20:
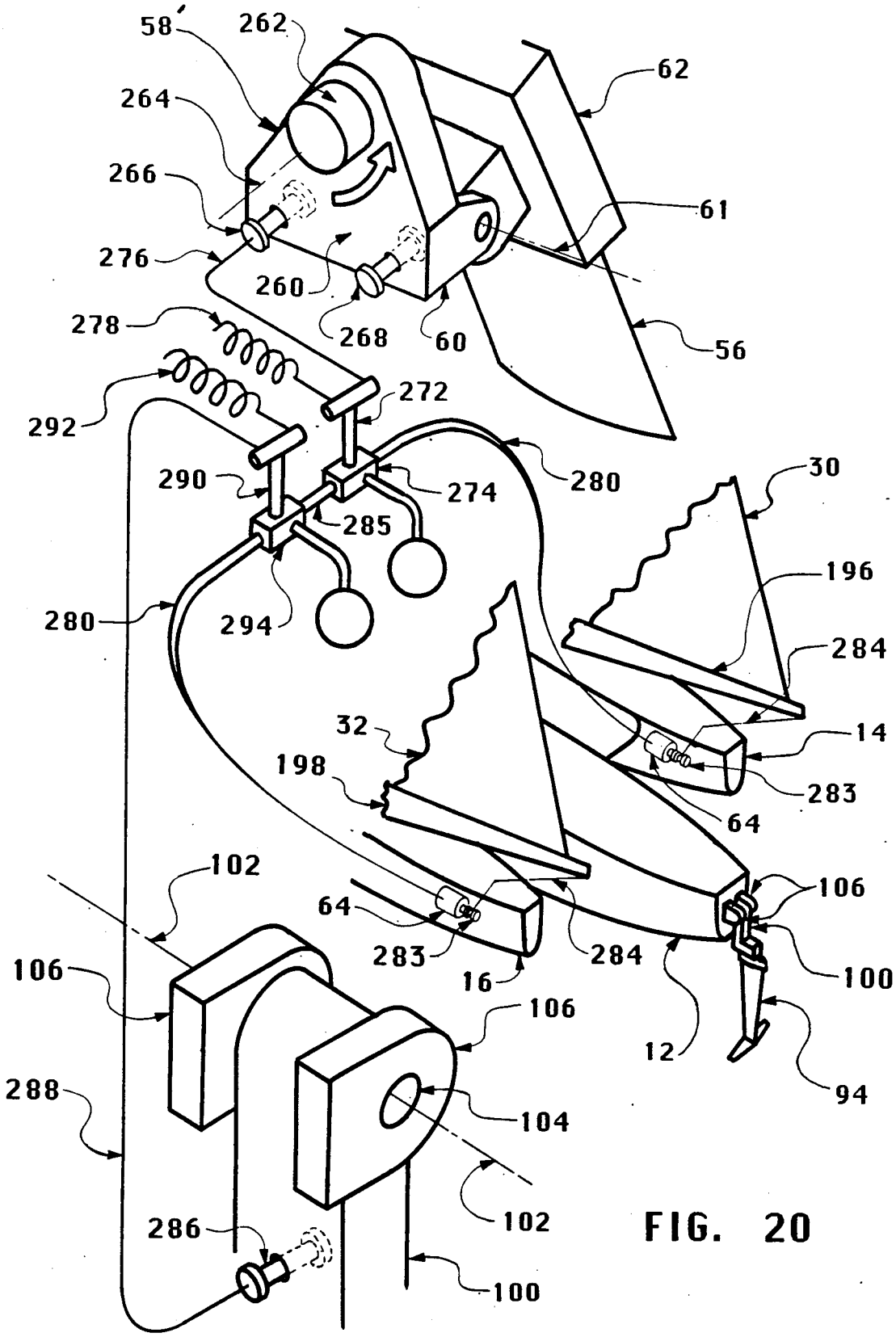
FIG. 20 is a diagrammatic illustration of a modified aileron foil and rudder mounting arrangement for the vessel of the invention.

To prevent such an occurrence the support beams 56 may be mounted on the sponsons 14 and 16 in an alternative manner to that depicted in FIGS. 10–13. Such an alternative aileron foil mounting means is illustrated in FIG. 20. In the arrangement of FIG. 20 the support beams 56 are mounted on the sponsons 14 and 16 by means of a modified mounting bracket 58'. The mounting bracket 58' has bracket ears 60 to which a support beam 56 is rigidly coupled by means of a bell crank assembly 62 of the type previously described. However, the backside 260 of the mounting bracket 58' which resides in contact with the outer surface of the sponson 14 or 16 is coupled to the sponson by means of a large cylindrical post 262 which extends into and is held in a corresponding socket in the facing surface of the sponson. Unrestrained, the mounting bracket 58' can rotate on the post 262 about a transverse axis 264.

The mounting bracket 58' is prevented from rotating relative to the side of the sponson to which it is attached by means of a pair of bolts 266 and 268. The bolts 266 and 268 prevent the mounting bracket 58' from rotating relative to the sponson about the transverse axis 264 under normal conditions. However, should an aileron foil strike a submerged or partially submerged article, the torsional force applied against the leading edge of the aileron foil will be transmitted as a moment acting in the direction indicated by the directional arrow 270 in FIG. 20. The torsional force from such an impact will be very large and will shear the shanks of the bolts 266 and 268 before significant damage occurs to the aileron foil 22 or 24, thereby causing the alternative aileron foil mounting means to yield. Once the shanks of the bolts 266 and 268 are sheared, the mounting bracket 58' is free to rotate in the direction indicated by the directional arrow 270 about the transverse axis 264. Thus, the aileron foil 22 or 24 and the support beam 56 to which it is connected, will both freely rotate rearwardly and upwardly relative to the sponson, along with the mounting bracket 58'. The rearward and upward rotation brings the aileron foil up out of the water, thereby exposing the aileron foil to only minimal damage. Furthermore, because the shanks of the bolts 266 and 268 have sheared, the mounting bracket 58' will not be torn out of the side of the sponson, but instead will merely rotate relative thereto about the axis 264.

If one of the aileron foils impacts against a submerged or partially submerged object and is rotated up and out of the water as the mounting bracket 58' rotates relative to the sponson, it is very important to luff the sails and eliminate the heeling force so the vessel will rapidly decelerate, otherwise it might well tip over. To achieve rapid deceleration, the mounting bolt 268 may be connected to a T-shaped valve actuating mechanism 272 for a "dead man" type valve 274 by means of a cable 276. Under normal circumstances the cable 276 is maintained in tension acting against one arm of the T-shaped valve actuator 272. The force on the cable 276 is counterbalanced by the use of an extended spring 278, which is maintained in tension and which acts against the other arm of the valve actuator 272. The counterbalancing forces between the spring 278 and the cable 276 hold the valve actuator 272 in a position so as to hold the valve 274 shut so that there is no path of hydraulic fluid flow from the hydraulic fluid lines 280 to an empty hydraulic fluid reservoir 282.

Each of the hydraulic fluid lines 280 leads to a separate hydraulic actuator 64 that controls a separate take-up reel 283 that in turn is coupled to a separate main sheet 284. One of the main sheets 284 is connected to the end of the boom 196 for the sail 30, while the other main sheet 284 is connected to the end of the boom 198 for the sail 32. The hydraulic fluid lines are coupled in communication with each other through the body of the valve 274 and through the body of another valve 294, hereinafter to be described, by a connecting duct 285. Under normal conditions, therefore, there is no hydraulic fluid flow through the lines 280 and the hydraulic actuators 64 are pressurized with hydraulic fluid and are actuated through other mechanisms to take in and let out the main sheets 284 for the sails 30 and 32.

In the event that one of the aileron foils 22 or 24 strikes a submerged object with an impact sufficient to shear the bolts 266 and 268, tension will be released on the cable 276 associated with the aileron affected. The spring 278 will thereupon rotate the T-shaped valve handle 272, thereby opening the valve 274 to relieve hydraulic fluid pressure from both of the main sheet hydraulic actuators 64. That is, hydraulic fluid will flow from the lines 280 into the reservoir 282 through the open valve 274. Without hydraulic pressure the hydraulic actuators 64 will release the take-up reels 283. The main sheets 284 will thereupon run free, thereby releasing the booms 196 and 198 so that the sails 30 and 32 will luff. Without the driving and heeling forces from the sails 30 and 32 the sailing vessel will rapidly but safely decelerate without rolling over.

To repair the system in the event of such an occurrence, the crew will manually rotate the mounting bracket 58' back downwardly until the bolt openings therein are aligned with corresponding openings in the sponson to which the mounting bracket 58' is attached. Replacement mounting bolts 266 and 268 will then be installed to again immobilize the mounting bracket 58' from rotation about the axis 264. The cable 276 will be recoupled to the replacement mounting bolt 268 and placed in tension. Hydraulic fluid will thereupon be replaced in the hydraulic actuators 64 that control the main sheets 264. The aileron foils 22 and 24 will thereupon be serviceable for use and the main sheets 284 will again operate under the control of the hydraulic actuators 64 associated therewith.

A similar safeguard is employed in connection with the rudder 94. The rudder 94 may be held in position depending from the stern of the main central hull 12 by means of a bolt 286 that holds the rudder beam 100 against the transom of the main central hull 12. A cable 288 is connected from the bolt 286 and leads to a T-shaped valve actuator 290. The cable 288 is maintained in tension and pulls against one leg of the T-shaped valve actuator 290. A counterbalancing force is maintained on the opposite leg of the T-shaped valve actuator by a coil spring 292, which is also maintained in tension.

Under normal operating conditions the tension in the cable 288 counterbalances the force of the spring 292 so that the valve actuator 290 maintains the valve 294 in a position in which there is n fluid communication between the hydraulic fluid lines 280 and the reservoir 296. If the rudder 94 impacts against a submerged object, the bolt 286 will fail, thereby allowing the rudder beam 100 to rotate upwardly and rearwardly relative to the mounting brackets 106 about the axis 102. Failure of the bolt 286 releases tension on the cable 288, thus allowing the spring 292 to contract, thereby rotating the valve actuator 290 from a closed to an open position. Once the valve 294 opens, hydraulic fluid will flow from lines 280, through the open valve 294 and into the hydraulic fluid reservoir 296. The release of hydraulic pressure in the hydraulic actuators 64 that control the main sheets 284 by draining of hydraulic fluid through the lines 280 into the reservoir 296 releases the take up reel 283. The take up reels 283 in turn free the main sheets 284 so that they run free. The booms 196 and 198 will thereupon assume a neutral position and the sails 30 and 32 will luff.

Following such an occurrence, the rudder 94 is redeployed in a manner analogous to redeployment of the aileron foils 22 and 24 in the event of a failure of bolts 266 and 268. That is, once the vessel has decelerated to a halt, the rudder beam 100 is rotated downwardly and forwardly relative to the mounting brackets 106 so that the rudder 94 again extends downwardly beneath the stern of the main central hull 12. A replacement bolt 286 is reinstalled to couple the rudder beam 100 to the transom of the main central hull 12 and tension is again exerted on the cable 288 to counterbalance the spring 292 to again turn the valve actuator 290 to a position in which the valve 294 is closed relative to the reservoir 296. The hydraulic actuators 64 which control the main sheets 284 are thereupon again supplied with sufficient hydraulic fluid to allow control and trimming of the main sheets 284 in a normal manner.

Figure 21:
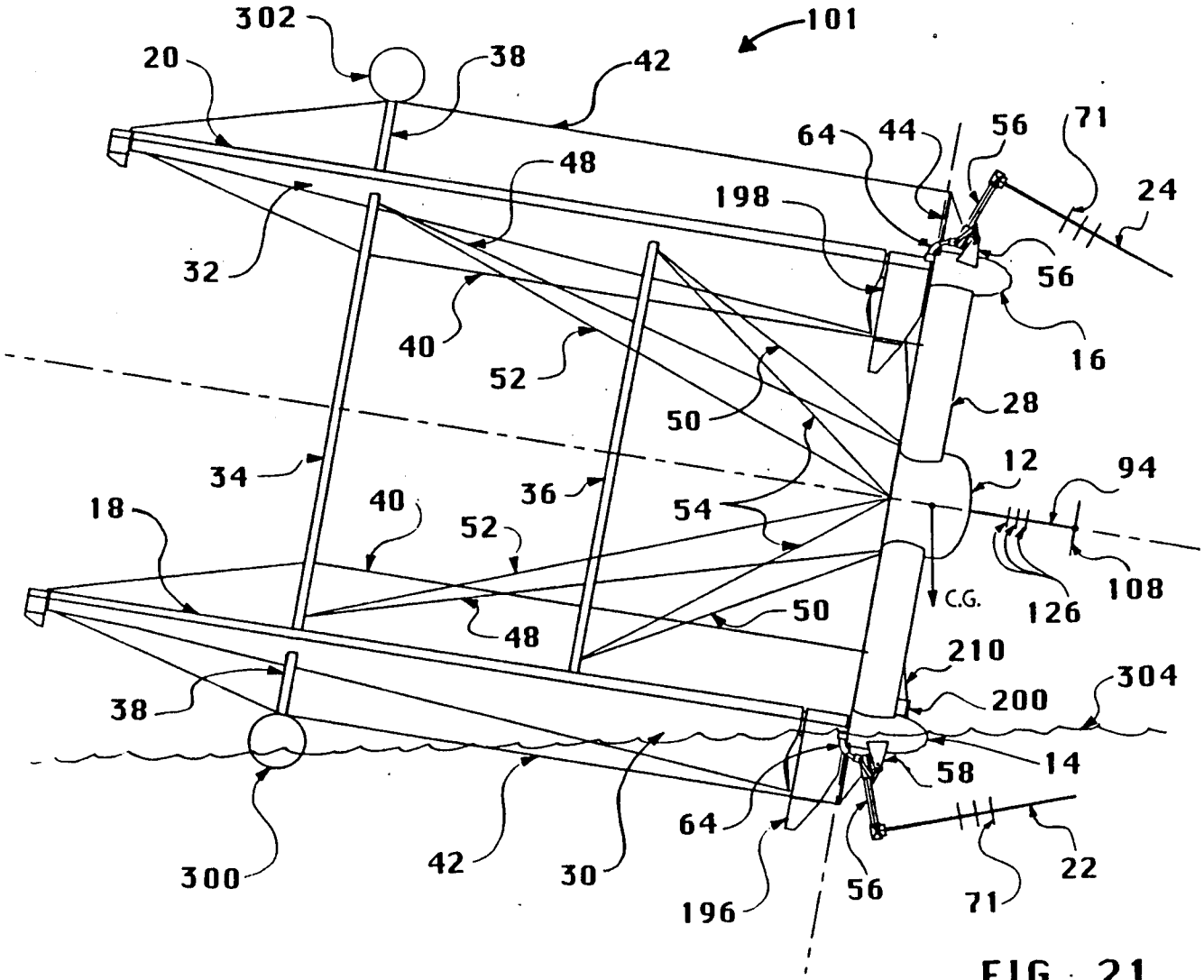
FIG. 21 is a front elevational view of a modified embodiment of the sailing vessel of FIG. 1 shown in a knocked down condition.

Since multi-hulled vessels can be unstable at times, it may be advisable to provide the sailing vessel of the invention with an additional safety feature to make it self-righting. FIG. 21 illustrates a sailing vessel 10' modified from the sailing vessel 10' of FIG. 1 by the addition of inflatable spherical floats 300 and 302 secured to the outboard ends of the transverse stabilizing strut system. The floats 300 and 302 may be inflated by air from a compressed air source, such as a scuba air tank, located in the central hull 12 of the sailing vessel 10'. The floats 300 and 302 are permanently and securely fastened to the outboard tips of the upper transverse stabilizing strut 34, and are inflated remotely from the central hull 12 through air lines (not shown) leading thereto that extend up the masts 18 and 20 and outboard to the ends of the transverse stabilizing strut 34.

In heavy wind conditions or in large waves the floats 300 and 302 may be inflated as a precaution. If the sailing vessel is knocked down on its starboard side, as depicted in FIG. 21, the float 300 on the leeward side of the vessel 10' will prevent the sailing vessel 10 from capsizing completely. Moreover, the leeward float 34 will hold the mast 18 up sufficiently so that the center of gravity of the sailing vessel 10' will act on the opposite side of the sponson 14 from the leeward float 300. As a result, even if the sailing vessel 10' is knocked down as depicted in FIG. 21, it will right itself due to the clockwise moment exerted on the sailing vessel 10' resulting from the force of gravity CG acting at the center of gravity of the sailing vessel 10'. The center of gravity lies within the main central hull 12. Although water in the leeward sail 30 may temporarily hold the sailing vessel 10' on its side, as depicted in FIG. 21, the pitching motion of the sea 304 will at some time rock the sailing vessel 10' with a clockwise moment, as viewed in FIG. 21. This will increase the moment arm of the gravitational force CG relative to the sponson 14, whereupon the sailing vessel 10' will right itself from the position of FIG. 21 to the position depicted in FIG. 3. The floats 300 and 302 will also accomplish the same results even if they are not inflated until after the sailing vessel 10' has capsized.

Undoubtedly, numerous variations and modifications of the invention will become readily apparent to those familiar with sailing vessels. The sailing vessel of the invention can be equipped with an engine so that it can move at moderate speeds with excellent fuel economy in light wind conditions, partially powered by the engine but aided by the force of the wind. Also, different stay and stabilizing strut configurations may be adopted to enhance the structural stability of the invention or to provide different loading configurations in the shrouds and stays that are connected to the load sensing and control means that govern the operation of the aileron foils 22 and 24 and the elevator foil 108. The configuration of the rudder beam may differ from that depicted, as well as the flaperon configuration. For example, each flaperon can be constructed in a square and carried by a pair of booms rather than a single boom. Accordingly, the scope of the invention should not be construed as limited to the specific embodiment and the manner of implementation described herein, but rather is defined in the claims appended hereto.

I claim:

1. A sailing vessel comprising: a central main hull, a pair of sponson located in mutually parallel alignment alongside said central main hull in spaced separation therefrom and rigidly joined thereto, a mast mounted on each sponson for carrying a sail, shrouds supporting said masts, a pair of aileron foils mounted outboard from said central main hull for rotation about separate axes of rotation which lie in a plane perpendicular to said sponsons and load sensing and foil control means coupled to at least some of said shrouds and to said aileron foils to rotate said aileron foils about said axes responsive to loads in said shrouds.

2. A sailing vessel comprising: a central main hull, a pair of sponson located alongside said central main hull in spaced separation therefrom and rigidly joined thereto a mast mounted on each sponson for carrying a sail, shrouds supporting said masts a pair of aileron foils mounted outboard from each of said sponsons about axes inclined toward each other and load sensing and foil control means coupled to at least some of said shrouds and to said aileron foils to rotate said aileron foils about said axes responsive to loads in said shrouds wherein said load sensing and foil control means is comprised of rotational driving means for each of said aileron foils for turning said aileron foils in rotation about their respective axes, an endless loop cable coupled to said rotational driving means whereby longitudinal advancement of said endless loop cable turns said aileron foils in counter-rotation relative to each other, and proportional load transducing means coupled to at least some of said shrouds to sensing loads in said shrouds and to advance said endless loop cable with forces directly proportional to loads sensed in said shrouds.

3. A sailing vessel according to claim 2 further comprising manually operable cable advancement adjustment means coupled to said endless loop cables in series with said proportional load transducing means to allow manual adjustment of advancement of said endless loop cable.

4. A sailing vessel according to claim 3 wherein said manually operable cable advancement adjustment means is comprised of trim pulleys in said endless loop cable and hydraulic actuators coupled to said trim pulleys.

5. A sailing vessel according to claim 2 further comprising passive roll foil means located on each of said aileron foils to project laterally therefrom on both sides of each of said aileron foils in fixed orthogonol orientation relative thereto.

6. A sailing vessel according to claim 1 further characterized in that said foils are respectively held in articulated fashion from said sponsons by support beams which are mounted on said sponsons in a rotatable manner, whereby said aileron foils are rotatable with said support beams to allow adjustment of the extent of inclination of said axes about which said aileron foils are rotatable.

7. A sailing vessel according to claim 6 further comprising hydraulic actuating means to rotate said beams relative to said sponsons.

8. A sailing vessel according to claim 1 further comprising a rudder located at the rear of said central main hull and an elevator foil disposed transversely relative to said rudder and mounted to said rudder for rotation about a transverse axis, and load sensing and elevator control means coupled to at least some of said shrouds and to said elevator foil to rotate said elevator about said transverse axis responsive to loads in said shrouds.

9. A sailing vessel according to claim 8 further comprising transversely projecting passive pitch foil means secured to said rudder and located above said elevator foil.

10. A sailing vessel according to claim 9 wherein said rudder is mounted for rotation about a vertical rudder post, and further comprising hydraulic rudder control means for controlling rotation of said rudder at said rudder post, a rudder beam carrying said rudder and said rudder post, transverse hinge means rotatably securing said rudder beam to said central main hull, and hydraulic actuating means coupled to rotate said rudder beam on said transverse hinge means to alternatively raise and lower said rudder relative to a body of water in which said central main hull and said sponsons float.

11. A sailing vessel according to claim 1 wherein each of said sails is comprised of a pair of sailcloths extending from a common leech and secured to a separate upright roller adjacent a mast, whereby said rollers are rotatable to selectively tighten and loosen said sailcloths to selectively adjust the area and aspect ratios of said sails.

12. A sailing vessel according to claim 11 further comprising reinforcing webbing on the inside surface of said sailcloths.

13. A sailing vessel according to claim 1 further comprising a monocoque bridge extending between said central main hull and said sponsons, a pair of flaperon booms extending rearwardly from said bridge adjacent each of said sponsons, whereby said flaperon booms are rotatable about transverse flaperon boom axes where they meet said bridge, and flexible sheets of material extending from each of said flaperon booms to said monocoque bridge wherein said flaperon booms and said sheets of material attached thereto form flaperons that are rotatable about said flaperon boom axes, whereby said flaperons are vertically adjustable relative to said sponsons.

14. A sailing vessel according to claim 1 wherein said aileron foils are coupled to said sponsons through aileron mounting means which yields upon application of predetermined force applied to an aileron foil in a direction parallel to alignment of said sponsons so as to thereupon allow said aileron foils to rotate freely relative to said sponsons about axes normal to alignment of said sponsons.

15. A sailing vessel according to claim 14 wherein said aileron mounting means is coupled to said sails on said masts to luff said sails when said aileron mounting means yields to allow free rotation of one of said aileron foils as aforesaid.

16. A sailing vessel comprising hull means including a central main hull an da pair of sponsons oriented parallel to each other and parallel to and on opposite sides of said central main hull and rigidly joined thereto, a pair of upright masts each carrying a sail and each mounted on a separate one of said sponsons, transversely directed stabilizing strut means extending between said masts above said sponson, separate shroud means supporting each of said masts, a separate aileron foil adapted to extend downwardly and outboard from said central main hull for rotation about separate axes of rotation which lie in a plane perpendicular to each of said sponsons, and load sensing and aileron control means mounted on said hull means and coupled to said aileron foils and to said shrouds to control the rotation of said aileron foils about said aileron axes as a function of load in said shrouds.

17. A sailing vessel according to claim 16 wherein floats are attached to both ends of said transverse stabilizing structure.

18. A sailing vessel comprising hull means including a central main hull and a pair of sponsons oriented parallel to and on opposite sides of said central main hull and rigidly joined thereto a pair of upright masts each carrying a sail and each mounted on a separate one of said sponsons transversely directed stabilizing strut means extending between said masts above said sponsons, separate shroud means supporting each of said masts a separate aileron foil adapted to extend downwardly on the outboard side of each of said sponsons and mounted for rotation about aileron axes and load sensing and aileron control means mounted on said hull means and coupled to said aileron foils and to said shrouds to control the rotation of said aileron foils about said aileron axes as a function of load in said shrouds wherein said load sensing means include aileron rotation actuating means which coupled said ailerons to move together in counter-rotation relative to each other, and proportional load transducing means coupled between said shroud means and said aileron rotation actuating means to transmit a fraction of loads in said shroud means to said aileron rotation actuating means.

19. A sailing vessel comprising bull means including a central main hull and a pair of sponsons oriented parallel to and on opposite sides of said central main hull and rigidly joined thereto a pair of upright masts each carrying a sail and each mounted on a separate one of said sponsons transversely directed stabilizing strut means extending between said masts above said sponsons separate shroud means supporting each of said masts a separate aileron foil adapted to extend downwardly on the outboard side of each of said sponsons and mounted for rotation about aileron axes and load sensing and aileron control means mounted on said hull means and coupled to said aileron foils and to said shrouds to control the rotation of said aileron foils about said aileron axes as a function of load in said shrouds, wherein said aileron load sensing and aileron control means includes aileron rotation actuating means which is comprised of an endless loop cable coupled to both of said ailerons, and proportional load transducer means coupled between said separate shroud means and said silicon rotation actuating means to transmit a fraction of loads in said shroud means to said aileron rotation actuating means, and wherein each of said separate shroud means is connected to separate ones of said masts and is comprised of inboard and outboard upper shroud means both connected from the top of a mast and both coupled to said proportional load transducing means.

20. A sailing vessel comprising hull means including a central main hull and a pair of sponson oriented parallel to and on opposite sides of said central main hull and rigidly joined thereto, a pair of upright masts each carrying a sail and each mounted on a separate one of said sponsons transversely directed stabilizing strut means extending between said masts above said sponsons separate shroud means supporting each of said masts a separate aileron foil adapted to extend downwardly on the outboard side of each of said sponsons and mounted for rotation about aileron axes and load sensing and aileron control means mounted on said hull means and coupled to said aileron foils and to said shrouds to control the rotation of said aileron foils about said aileron axes as a function of load in said shrouds, a rudder located at the rear of said central main hull, an elevator foil mounted on said rudder for rotation about an elevator axis extending transversely through said rudder, and load sensing and pitch control means coupled to both of said separate shroud means and to said elevator foil to rotate said elevator foil about said elevator axis in response to loads on said shroud means.

21. A sailing vessel according to claim 20 wherein said load sensing and pitch control means is comprised of a pair of proportional load transducers located on opposite sides of said central main hull, and a pair of elevator cables coupled together and to said elevator foil and to said load transducers, and said separate shroud means are each comprised of aft stay means leading from said masts and connected to said proportional load transducers.

22. A sailing vessel according to claim 21 wherein each of said aft stay means is comprised of both upper and lower aft stays both coupled to a common proportional load transducer.

23. A sailing vessel according to claim 19 wherein said proportional load transducing means is comprised of sets of proportional load transducers for each sponson, and each set of proportional load transducers includes an inboard load transducer and an outboard load transducer respectively connected to said inboard upper shroud and to said outboard upper shroud of the separate shroud means for the mast mounted on the same sponson.

24. A sailing vessel according to claim 19 wherein each of said separate shroud means is further comprised of cross stay means extending from an elevated location on the mast mounted on one sponson to the base of the mast mounted on the opposite sponson, and said proportional load transducing means is coupled between said shroud means and said aileron rotation actuating means to transmit a fraction of loads in said shroud means to said aileron rotation actuating means.

25. A sailing vessel according to claim 19 further comprising forestay means extending from each mast to the front of the sponson upon which that mast is mounted.

26. A sailing vessel according to claim 21 wherein said forestay means is further comprised of a forestay extending from each mast to the front of said central main hull.

27. A sailing vessel according to claim 20 further comprising a rudder located at the rear of said central main hull, an elevator foil mounted on said rudder for rotation about a transverse elevator axis through said rudder, and load sensing and pitch control means located at the rear of said central main hull and coupled to said elevator foil to rotate said elevator foil about said transverse elevator axis, and wherein each of said separate shroud means is comprised of aft stay means extending from said masts to said load sensing and pitch control means, whereby said elevator foil rotates about said transverse elevator axis in response to loads in said aft stay means.

28. A sailing vessel according to claim 27 wherein each of said aft stay means is comprised of at least upper and lower aft stays.

29. In a sailing vessel having a central main hull, a pair of mutually parallel sponsons rigidly connected to said central main hull and located parallel to and on opposite sides thereof, a mast carrying a sail thereon mounted on each of said sponson, separate shroud systems supporting each of said masts, the improvement comprising separate aileron foils extending downwardly and located outboard from said central main hull and rotatable about axes lying in a common vertical plane that is perpendicular to said sponsons to vary the angle of attack of said aileron foils moving through water, strut means extending between said masts above said sponsons to stabilize said masts relative to each other, and load sensing and control means secured relative to said central main hull and to said sponsons and coupled to said shroud systems to sense loads therein and coupled to said aileron foils to rotate said aileron foils about said axes responsive to loads in said shroud systems.

* * * * *